US010597906B2

(12) United States Patent
Engibarov et al.

(10) Patent No.: US 10,597,906 B2
(45) Date of Patent: Mar. 24, 2020

(54) TAMPER-RESISTANT LOCK

(71) Applicant: ENGBAR INC., Las Vegas, NV (US)

(72) Inventors: Eddy Engibarov, Las Vegas, NV (US); Larrie Thomas, Las Vegas, NV (US); Dontcho Denkov, Las Vegas, NV (US)

(73) Assignee: ENGBAR INC, Las Vegas, NV (US)

( * ) Notice: Subject to any disclaimer, the term of this patent is extended or adjusted under 35 U.S.C. 154(b) by 0 days.

(21) Appl. No.: 16/538,416

(22) Filed: Aug. 12, 2019

(65) Prior Publication Data

US 2019/0360239 A1 Nov. 28, 2019

Related U.S. Application Data

(63) Continuation-in-part of application No. 16/127,428, filed on Sep. 11, 2018, now Pat. No. 10,422,165, which is a continuation of application No. 15/699,617, filed on Sep. 8, 2017, now Pat. No. 10,100,557.

(60) Provisional application No. 62/881,984, filed on Aug. 2, 2019, provisional application No. 62/522,459, filed on Jun. 20, 2017.

(51) Int. Cl.

| | |
|---|---|
| ***E05B 67/24*** | (2006.01) |
| ***E05B 67/06*** | (2006.01) |
| ***E05B 17/20*** | (2006.01) |
| *E05B 15/10* | (2006.01) |

(52) U.S. Cl.

CPC ..... *E05B 67/24* (2013.01); *E05B 17/2088* (2013.01); *E05B 67/063* (2013.01); *E05B 15/10* (2013.01)

(58) Field of Classification Search

CPC ..... F16B 23/0061; F16B 23/0069; F16B 41/005; E05B 67/24; E05B 67/063; E05B 17/2088; E05B 15/10; E05B 67/38; E05B 67/383; E05B 67/36; E05B 67/365

USPC ... 70/2, 6–13, 20, 31, 51–56, 395, 403, 404, 70/229–232, DIG. 57, 32–34.386, 276, 70/413; 81/125, 177.85

See application file for complete search history.

(56) References Cited

U.S. PATENT DOCUMENTS

| | | | |
|---|---|---|---|
| 294,524 | A | 3/1884 | Stiemke |
| 3,859,826 | A | 1/1975 | Singer et al. |

(Continued)

OTHER PUBLICATIONS

U.S. Appl. No. 16/127,428, filed Jan. 3, 2019, Office Action.
U.S. Appl. No. 16/127,428, filed May 14, 2019, Notice of Allowance.

*Primary Examiner* — Lloyd A Gall
(74) *Attorney, Agent, or Firm* — Workman Nydegger

(57) ABSTRACT

A locking system includes a tamper-resistant lock and key. The tamper-resistant lock can include a cylindrical lock body with an upper portion having an engagement surface defining a pattern of engagement features, a housing, and a hidden component sized and shaped to fit within the housing that includes an internal lock base into which the cylindrical lock body fastens and a padlock pin configured to secure the internal lock base to a hasp or staple. The key operable for use with the tamper-resistant lock can include a cylindrical key body defining an engagement cavity configured to receive the engagement surface of the cylindrical lock body, a set of complementary engagement features, a plurality of retractable engagement members, and a retractable collar at least partially covering the cylindrical key body.

20 Claims, 24 Drawing Sheets

(56) References Cited

U.S. PATENT DOCUMENTS 4,044,647 A 8/1977 Takahashi
4,362,035 A * 12/1982 Vitale ..... E05B 13/101 217/107
4,710,082 A 12/1987 Curtis
4,733,584 A * 3/1988 Karge ..... B25B 23/0035 81/177.2
5,542,273 A * 8/1996 Bednarz ..... E05B 67/365 29/263
5,603,472 A 2/1997 Hutter, III
5,669,255 A * 9/1997 Albano ..... E05B 17/2084 70/381
6,006,631 A 12/1999 Miner et al.
6,302,630 B1 10/2001 Grant
6,378,405 B1 4/2002 Miller et al.
6,386,006 B1 * 5/2002 DeWalch ..... E05B 19/00 70/34
6,641,343 B1 11/2003 Duran
7,377,137 B1 * 5/2008 Bednarz ..... E05B 63/121 403/322.2
8,739,662 B2 * 6/2014 Huang ..... B25G 1/043 408/95
9,188,149 B2 11/2015 Bennett
10,100,557 B1 10/2018 Engibarov et al.
10,422,165 B2 * 9/2019 Engibarov ..... E05B 35/008
2003/0019259 A1 * 1/2003 Nicodemus ..... B25B 13/485 70/233
2005/0016333 A1 * 1/2005 Compton ..... B23B 31/1071 81/177.85
2008/0121075 A1 * 5/2008 Meng ..... B25B 15/001 81/177.85
2009/0113960 A1 * 5/2009 Medina ..... F16B 19/02 70/232
2010/0054854 A1 3/2010 Wang et al.
2011/0056340 A1 3/2011 Hsu
2013/0333528 A1 12/2013 Su
2015/0000625 A1 1/2015 Newman et al.

* cited by examiner

TAMPER-RESISTANT LOCK

CROSS-REFERENCE TO RELATED APPLICATIONS

This application is a continuation-in-part of pending U.S. patent application Ser. No. 16/127,428, filed Sep. 11, 2018 and titled "TAMPER-RESISTANT LOCK," now U.S. Pat. No. 10,422,165 which is a continuation of U.S. patent application Ser. No. 15/699,617, filed Sep. 8, 2017 and titled "TAMPER-RESISTANT LOCK," now U.S. Pat. No. 10,100,557, which claims priority to and the benefit of U.S. Provisional Patent Application Ser. No. 62/522,459, filed Jun. 20, 2017 and titled "UNIVERSAL THOMAS LOCK." This application also claims priority to and the benefit of U.S. Provisional Patent Application Ser. No. 62/881,984, filed Aug. 2, 2019 and titled "TAMPER-RESISTANT LOCK." The entirety of each of the above-cited applications is incorporated herein by this reference.

BACKGROUND

Technical Field

This disclosure generally relates to locking systems. Particularly, this disclosure relates to systems that include a tamper-resistant lock and components for securing the same.

Related Technology

There are many items that people want to keep safe or which are desired to be kept free from interference or tampering by others. In many instances these items are sealed with a container or behind a barrier using a lock, and only individuals with the appropriate key can access the contents sealed behind the lock. However, many locks can be picked or easily circumvented.

Accordingly, there are a number of disadvantages with locking systems that can be addressed.

BRIEF SUMMARY

Implementations of the present disclosure solve one or more of the foregoing or other problems in the art with locking systems. In particular, one or more implementations can include a tamper-resistant lock and a key. An exemplary tamper-resistant lock can include a cylindrical lock body that includes a flange disposed between a lower portion and an upper portion, the lower portion having a threaded stem, and the upper portion having a circumferential channel formed into a circumferential sidewall of the upper portion and an engagement surface defining a pattern of engagement features. The tamper-resistant lock can additionally include a housing having a bore formed into a top surface thereof and a bore cap sized and shaped to fit within and occlude the opening of the bore. The bore cap can be made of or include ferrous material and have a head with a flat, continuously smooth top surface such that in a secured position within the bore, the top surface of the bore cap is configured to be flush with a planar surface of the housing. The tamper-resistant lock can additionally include a hidden component sized and shaped to fit within the housing. The hidden component can include an internal lock base that defines a complementary threaded bore into which the threaded stem of the cylindrical lock body fastens and a padlock pin configured in size and shape to fit within a cavity formed in a sidewall of the internal lock base and to pass through the eye of a hasp or staple to thereby secure the internal lock base to the hasp or staple.

An exemplary key operable for use with the tamper-resistant lock can include a cylindrical key body sized and shaped to be at least partially disposed within the bore of the housing, the cylindrical key body defining an engagement cavity configured to receive the engagement surface and the pocket of the upper portion of the cylindrical lock body. The key can additionally include a magnet associated with the cylindrical key body and/or a set of complementary engagement features defined by an interaction surface of the cylindrical key body, the interaction surface being disposed within the engagement cavity. The key can additionally include a plurality of retractable engagement members disposed within corresponding openings defined by the cylindrical key body and a retractable collar at least partially covering the cylindrical key body.

In one aspect, the key includes a retention spring fixedly secured to the cylindrical key body and positioned on a first side of a spring disposed around the cylindrical key body and underneath the retractable collar to provide tension to an axial movement of the retractable collar.

In one aspect, the retractable collar is movable between a retracted state and a non-retracted state and the key is operable to disengage the cylindrical lock body from the tamper-resistant lock only in the non-retracted state with the pattern of engagement features of the tamper-resistant lock aligned with the set of complementary engagement features of the key and the retractable collar biasing the plurality of retractable engagement members into the circumferential channel.

Accordingly, locking systems are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

Overview of Locking Systems

Many public utilities are having valuable components stolen or tampered with by unauthorized personnel. For example, copper wire is being pilfered from electrical light posts and/or from within electrical boxes mounted within sidewalks or otherwise existing in a public space. The thieves or other mischievous individuals access the desired materials using the same access points as technicians or other authorized personnel.

Problematically, many of the access points are sealed with traditional bolts having a hexagonal head, and a nefarious individual can use common tools to open these access points. For example, if an access point is sealed with traditional bolts, a properly sized (and likely generally available) wrench can be used to remove the sealing bolts and by doing so, grant the wrench-wielder access to the previously sealed access point. As an additional example, if the access point is sealed using a traditional lock, the lock can be cut away or easily picked. New locking systems are needed to address this problem.

As yet another example, various goods and materials are stolen from shipping containers, trailers, and railcars and/or from within storage and other commercial and private facilities. The thieves or other mischievous individuals are often able to access the desired goods or materials using the same entryways or access points as the owners or otherwise authorized personnel by picking or breaking whatever locking mechanism is place, using commonly accessible methods and/or tools.

Exemplary Locking Systems

Embodiments of the present disclosure enable a locking system (e.g., the Universal Thomas Lock) that is tamper resistant and difficult to pick, remove, or otherwise break without use of the proper key, and in some instances, without the appropriate knowledge of the stepwise disengagement of the locking system. These locking systems can be implemented de novo or as a retrofit to light posts, electrical boxes, or any other housing that would benefit from a more secure and/or tamper-resistant locking system.

Figure 1:
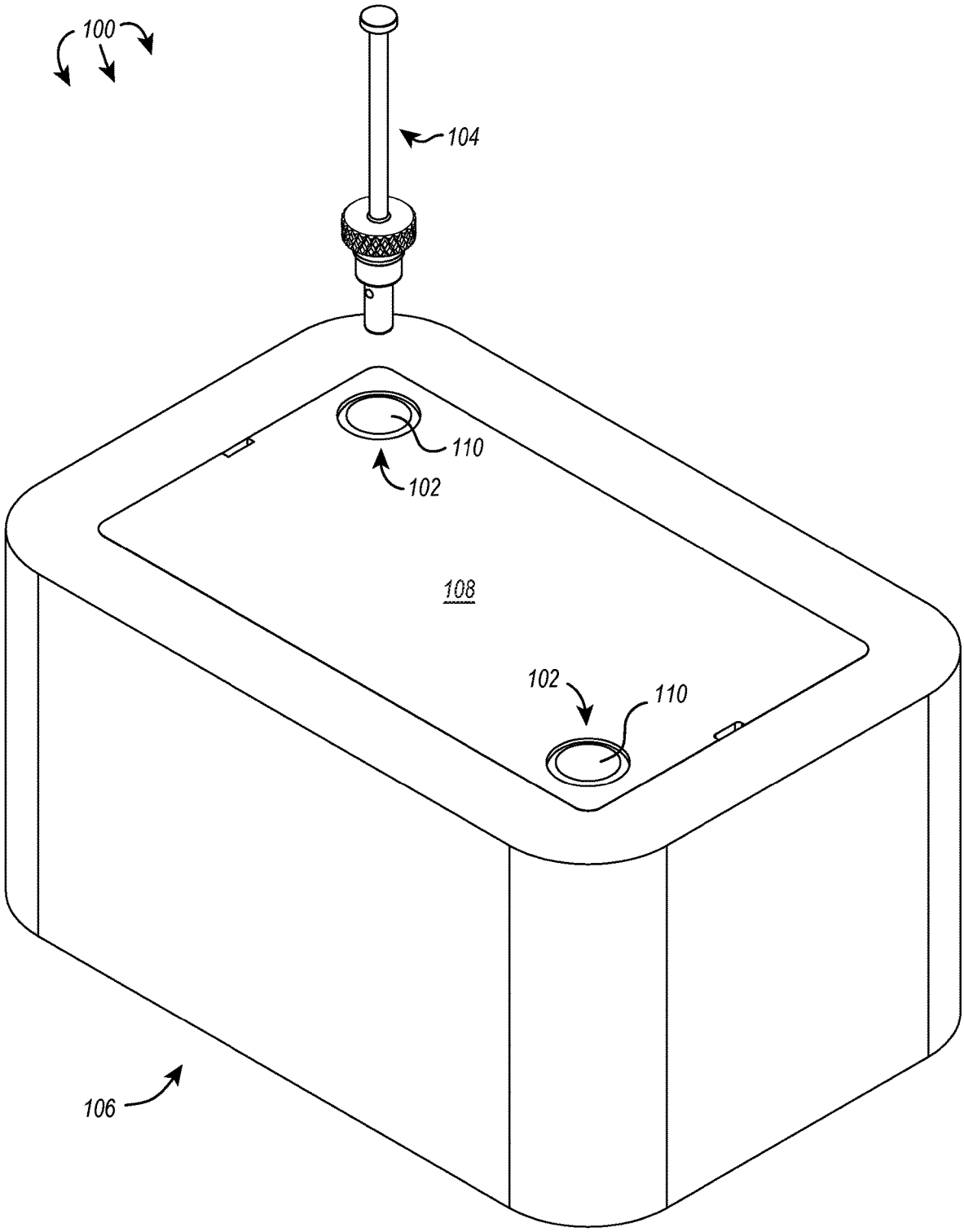
FIG. 1 illustrates a perspective view of an exemplary locking system.

FIGS. 1-4, for example, illustrate an exemplary locking system 100 of the present disclosure. As illustrated in FIG. 1, the locking system 100 includes two tamper-resistant locks 102 and a key 104. The two tamper-resistant locks 102 are engaging a housing 106 through the housing lid 108, thereby securing the lid 108 to the housing 106. In some embodiments, the housing 106 is an electrical box having electrical outlets, electrical components, conduits, access points, and/or meters. In some embodiments, the housing 106 is part of and/or in communication with a light post. In some embodiments, the housing 106 is a drop box, safe, or munitions container.

As can be seen in FIG. 1, each tamper-resistant lock 102 includes a bore cap 110, and each bore cap 110 is arcuate with a smooth top surface. In some embodiments, and as illustrated in FIG. 1, the bore cap 110 can be substantially circular. Due to the arcuate (or circular) nature of the bore cap 110, in addition to its smooth surface, there is a conspicuous lack of engagement surfaces for traditional tools. In other words, the bore cap 110 is not shaped to accommodate traditional crescent wrenches, and there are no grooves or patterns on the surface of the bore cap 110 that would allow a screwdriver or hex key (e.g., an Allen wrench) to grip, engage, or remove the cap. As such, the shaping and/or contour of the bore cap 110 can, in some embodiments, provide a first level of tamper resistance to the locking systems disclosed herein. To a casual observer or potential thief, there is no readily obvious way of removing the lock to open the lid as it appears to be riveted closed, fastened, or otherwise installed with a specialized tool.

Figure 2:
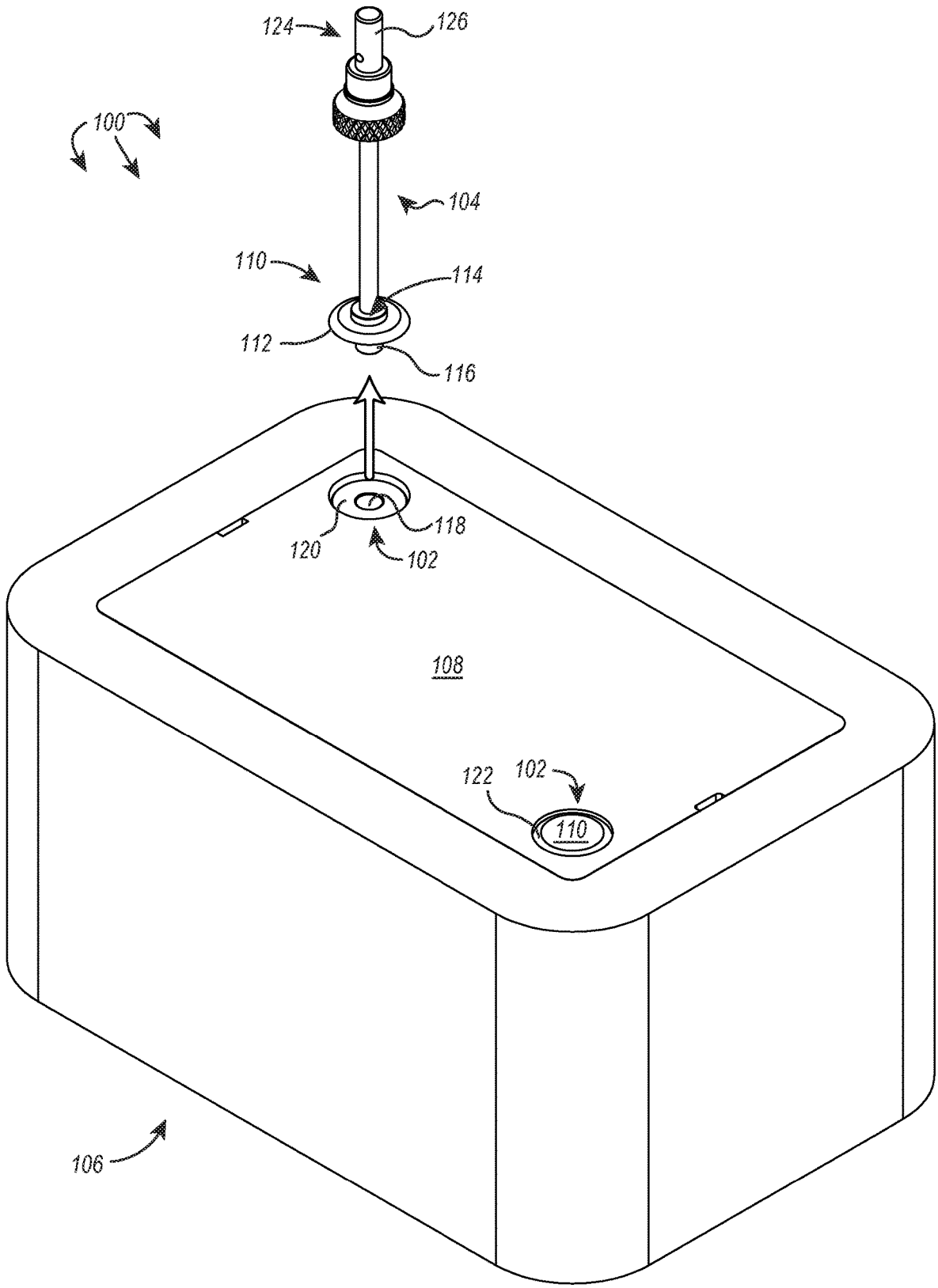
FIG. 2 illustrates a perspective view of the exemplary locking system of FIG. 1 with a cap removed, revealing the lock chamber.

In some embodiments, the bore cap 110 (or at least a head 112 thereof) is made of a ferrous material (e.g., iron, an iron alloy, or other magnetic material), and as shown in FIG. 2, the bore cap 110 can be engaged by and removed using a magnet 114. The magnet 114 is illustrated as part of the key 104, which is used in conjunction with the tamper-resistant lock 102. To remove the bore cap 110, the magnet 114 magnetically engages the head 112 of the bore cap 110, and the magnetic force between the head 112 and the magnet 114 is greater than the resistive force of the stem 116 on the sidewall that defines the bore 118. Accordingly, the magnet 114 gains and retains a hold of the bore cap 110, allowing it to draw the stem 116 away from the bore 118 to disassociate the bore cap 110 from the cylindrical lock body 120.

In some embodiments, the bore cap includes a magnetic undersurface (or is itself magnetic), and the bore cap is magnetically held to a top surface of an associated ferrous cylindrical lock body. The magnet of the key would, consequently, need to be a more powerful magnet such that it can overcome the magnetic force holding the bore cap to the cylindrical lock body.

In some embodiments, the bore cap includes or is made of a resilient material (e.g., non-ferrous metals or metal alloys, carbon fiber or glass reinforced composite materials, etc.), and the key includes a suction cup or vacuum that can be used to draw the bore cap from the bore of the cylindrical lock body.

In some embodiments, and as shown in FIGS. 1 and 2, the bore cap 110 includes a beveled edge 122 that is recessed below a surface of the lid 108 and that is in close proximity to a sidewall of the recess in the lid such that a prying tool cannot be leveraged underneath the beveled edge 122 to pry the bore cap 110 away from the cylindrical lock body 120.

In some embodiments, the bore cap 110, cylindrical lock body 120, or any other component of the tamper-resistant lock 102 and/or key 104 can be made from a hardened or strengthened material that resists drilling, concussive forces (e.g., hammer blows), slashing, tearing, or other destructive forces such as burning and low energy explosives. For example, the foregoing components can be made of hardened stainless steel. Thus, even at the superficial level of the bore cap 110, the tamper-resistant locks disclosed herein can be implemented to resist destructive tampering and prying, and there is beneficially (from the perspective of the lock owner) no obvious means of engaging the bore cap, which provides a first layer of defense against potential intrusive forces.

With continued reference to FIG. 2, once the bore cap 110 is removed, the top of the cylindrical lock body and the bore 118 become apparent. Similar to the bore cap 110, however, the top of the cylindrical lock body and the bore 118 appear, at least superficially, to be unremarkable. That is, these components are not shaped to receive and/or engage traditional tools such as a screwdriver or wrench.

Figure 3A:
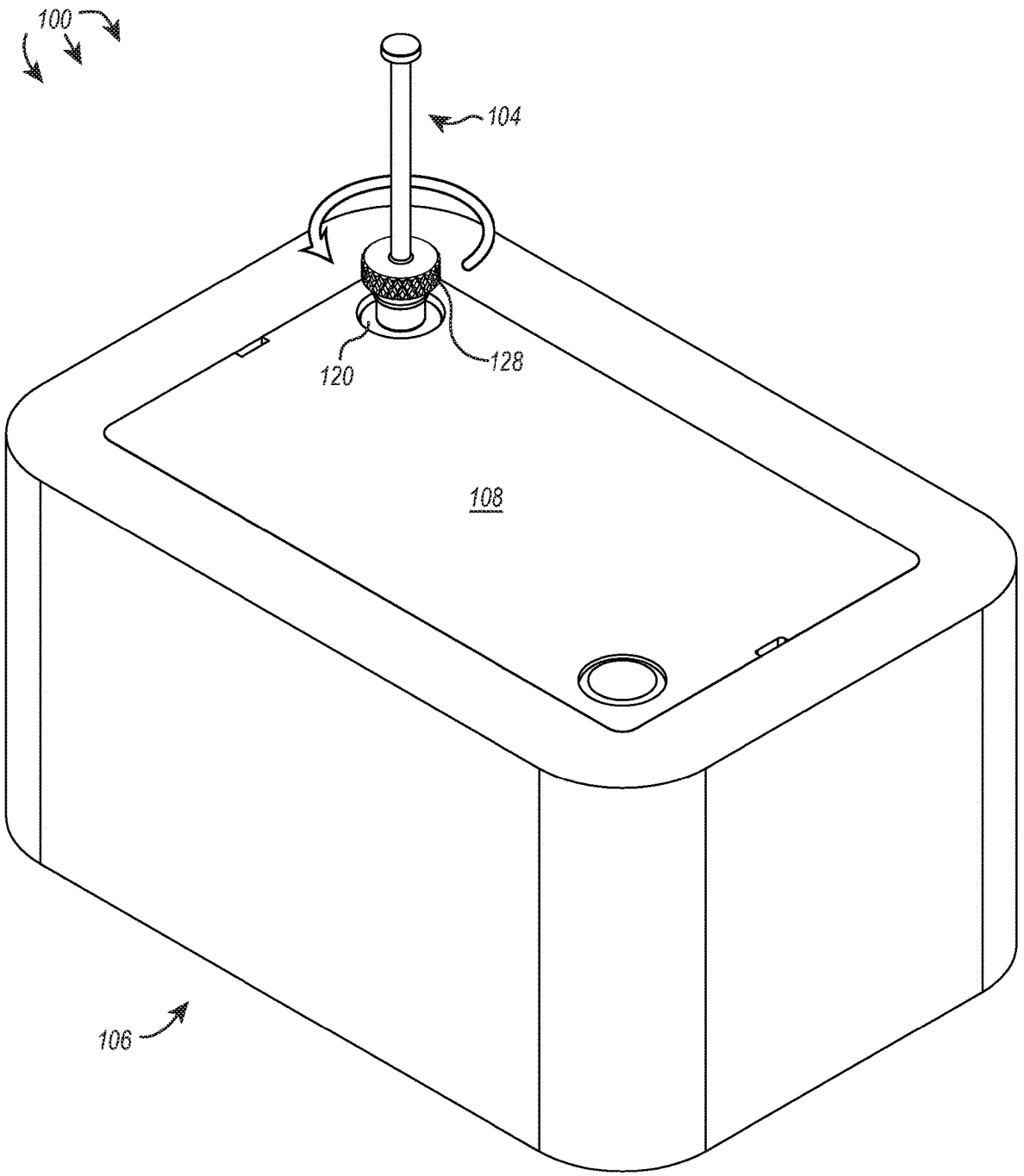
FIG. 3A illustrates a perspective view of the exemplary locking system of FIG. 2 with the key engaging the lock.
Figure 3B:
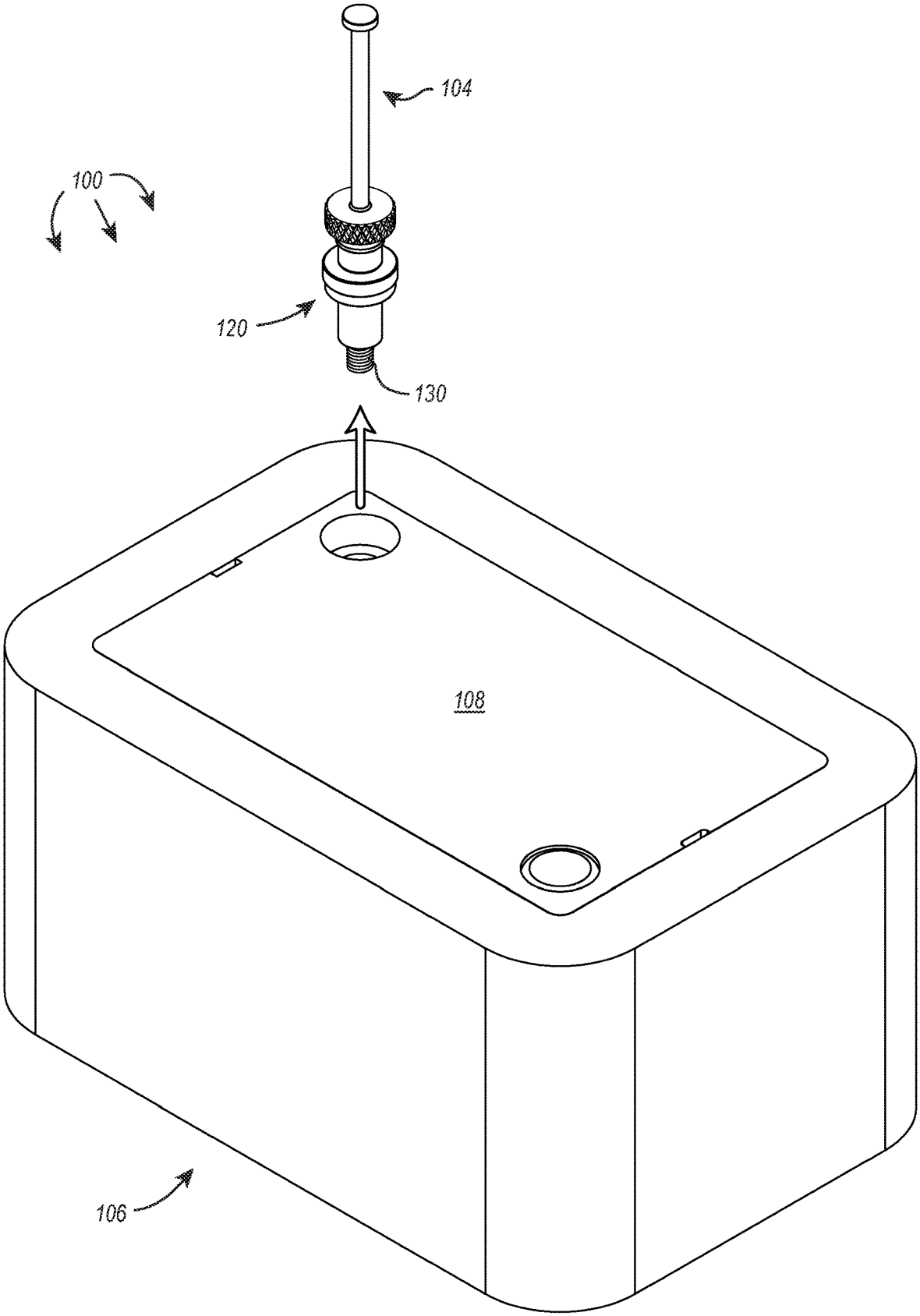
FIG. 3B illustrates a perspective view of the exemplary locking system of FIG. 3A with the lock removed from the housing.

As shown in FIGS. 3A and 3B, the key 104 can be used to disengage the cylindrical lock body 120 from the housing 106 and/or lid 108. The key 104 includes a collar 124 with a cylindrical key body 126 that is sized and shaped to fit within the bore 118, and when the cylindrical key body 126 is positioned within the bore 118, it engages the cylindrical lock body 120. A subsequent rotational force applied to the key 104 disengages the cylindrical lock body 120 from the housing 106 and/or lid 108. In some embodiments, and as shown in FIG. 3A, a gripping region 128 can be provided on the key 104 to assist the user in rotating the cylindrical lock body 120.

As shown in FIG. 3B, the cylindrical lock body 120 includes at least a length thereof that has external threads 130. Accordingly, rotational forces applied to the cylindrical lock body 120 cause it to fasten and unfasten from the housing 106. In some embodiments, the threads are oriented to cause the cylindrical lock body 120 to fasten in a clockwise direction and unfasten in a counterclockwise direction—the traditional "righty-tighty, lefty-loosey" configuration. In some embodiments, the external threads are oriented in an opposite configuration such that counterclockwise rotations cause the cylindrical lock body 120 to fasten, and clockwise rotations cause the cylindrical lock body 120 to unfasten. The reconfiguration of threading can add to the tamper-resistant nature of the lock as the counterintuitive rotation for unfastening the cylindrical lock body from the housing can frustrate the efforts of unauthorized persons. Theft and/or the unauthorized access of a locked space is often a time sensitive undertaking, and without advance notice of mechanical processes such as the thread orientation of a threaded lock body, the typical rotational direction is likely to be attempted first. At the very least, additional time will be needed to discern the proper directionality of rotation to unfasten the cylindrical lock body, assuming the unauthorized person is in possession of the key.

Figure 4:
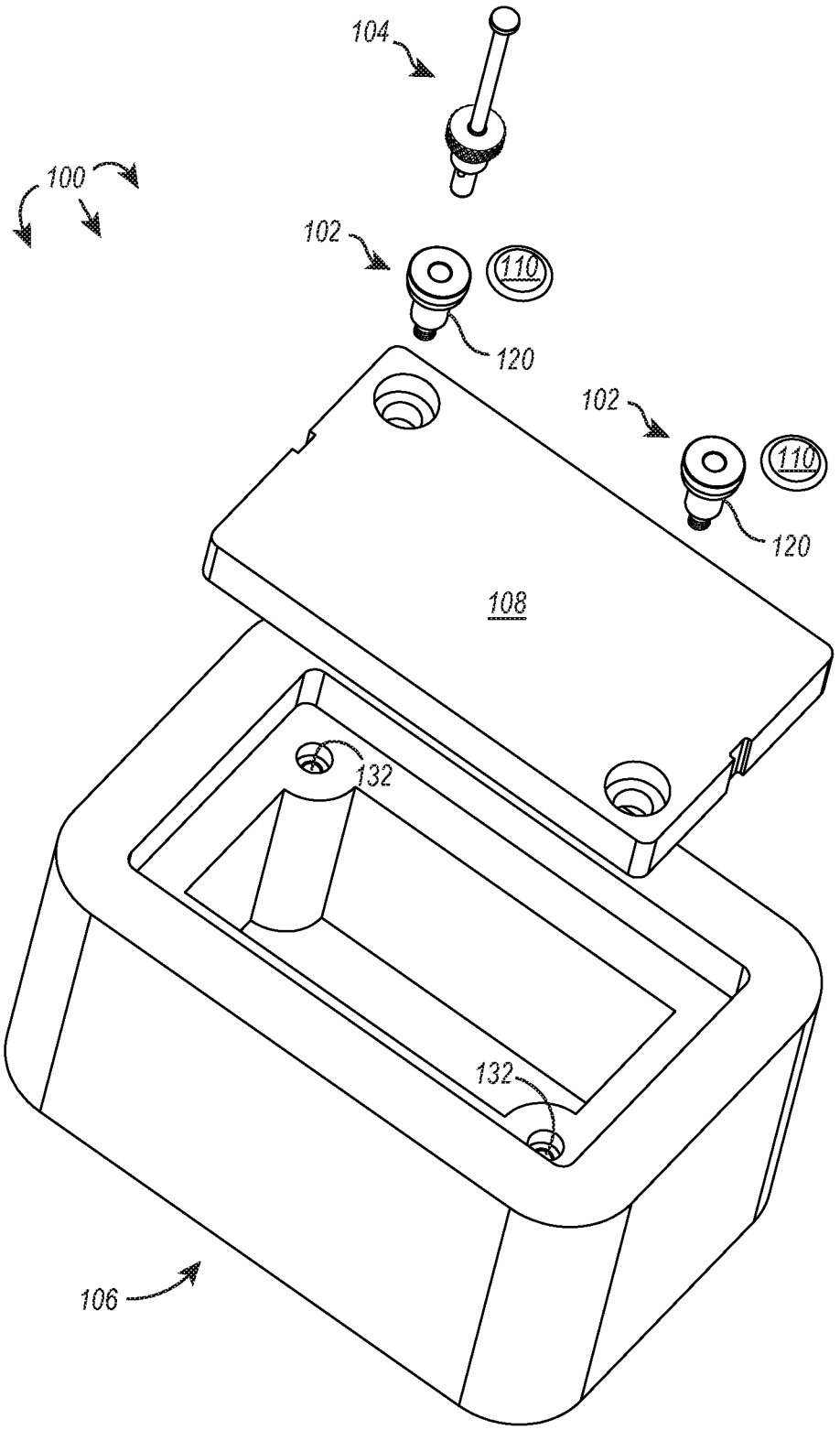
FIG. 4 illustrates an exploded perspective view of the exemplary locking system of FIG. 1 with both of the illustrated locks being disengaged and the lid being removed from the housing.

Referring now to FIG. 4, the locking system 100 is shown in a disassembled state. The two tamper-resistant locks 102 have been removed from associated housing anchors 132 using the key 104. The lid 108 can then be removed from the housing 106 to reveal the housing's internal compartment. As shown in FIG. 4, each housing anchor 132 includes a complementary threaded bore into which the cylindrical lock body 120 of each tamper-resistant lock 102 can fasten.

Exemplary Tamper-Resistant Locks and Associated Keys

The keys used for the tamper-resistant locks disclosed herein are somewhat different than traditional keys (i.e., key used in tumbler or pin-based locks). Traditional keys used for pin-based locks are cut into a particular conformation that will cause differently sized pins within the associated locking mechanism to align, allowing the lock to rotate. If one of the key's teeth is too short or too long, the associated pin will be misaligned, preventing the locking mechanism from freely rotating. These keys typically have a slim profile, as the pins are all oriented within the same plane within the locking mechanism.

Figure 5:
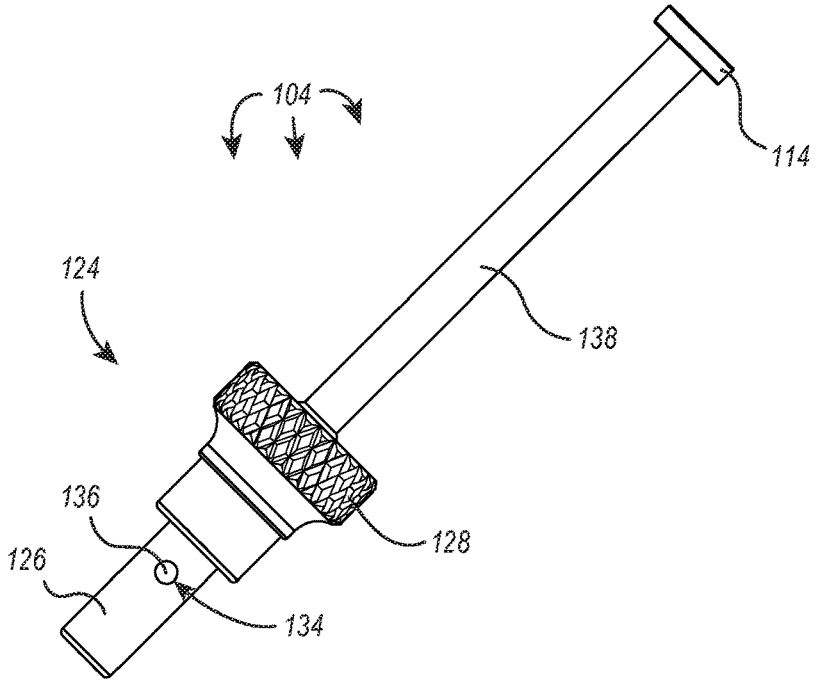
FIG. 5 illustrates an exemplary key for use with tamper-resistant locks disclosed herein.

FIG. 5 illustrates an exemplary key 104 of the present disclosure. Unlike keys typically used with pin-based locking mechanisms that have a slim profile, the key 104 of FIG. 5 includes a collar 124 that has a cylindrical key body 126. The cylindrical key body 126 is sized and shaped to fit within the bore of the cylindrical lock body 120, which is also cylindrically shaped. The side wall of the cylindrical key body 126 defines an opening 134 into which a retractable engagement member 136 is disposed. In some embodiments, the key includes a single retractable engagement member. In some embodiments, and as shown in the cross-sections of FIGS. 6A and 6B, the cylindrical key body 126 can define a plurality of openings 134 into which retractable engagement members 136, 136*a* can be placed. It should be appreciated that because the cylindrical key body 126 is shaped to engage a multidimensional surface, the positioning of retractable engagement members 136 on the cylindrical key body can similarly be multidimensional.

Figure 6A:
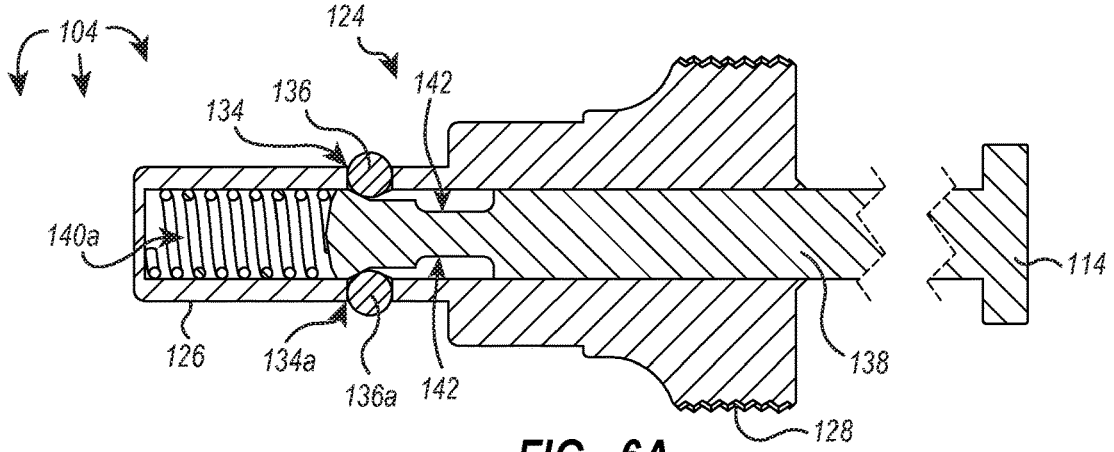
FIG. 6A illustrates a cross-section of the exemplary key of FIG. 5 with the internal spring in a decompressed state.

For example, retractable engagement members can be placed on opposite sides of the cylindrical lock body but otherwise within the same horizontal plane (as shown in FIG. 6A). As an additional example, retractable engagement members can be placed adjacent each other while still remaining in the same horizontal plane. Additionally, or alternatively, retractable engagement members can be placed adjacent and/or opposite each other in the same vertical plane. Additionally, or alternatively, retractable engagement members can be placed adjacent and/or opposite each other in different vertical and/or horizontal planes. By varying the number and/or placement of retractable engagement members vertically and/or horizontally on the cylindrical key body, unique key configurations can be achieved.

As alluded to above and as further shown in FIG. 5, the key 104 can include a gripping region 128. In some embodiments, the gripping region 128 has a larger diameter than the cylindrical key body 126. The larger diameter of the gripping region 128 allows a greater amount of torque to be applied to the key, and as shown in FIG. 5, the gripping region 128 can include knurling to increase grip at the gripping region. In some embodiments, the knurling is replaced with a textured material. In some embodiments, the gripping region is etched to provide a contoured surface that likewise increases grip. In some embodiments, the gripping region is covered with a rubberized material or thermoplastic elastomer that increases a user's grip at the gripping region.

Figure 6B:
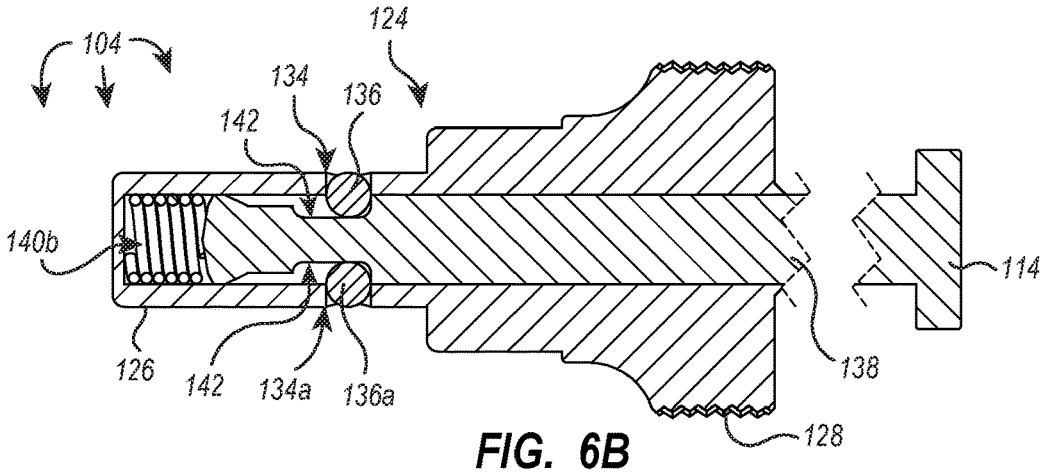
FIG. 6B illustrates a cross-section of the exemplary key of FIG. 5 with the internal spring in a compressed state.

The key 104 can additionally include a plunger 138 with the magnet 114 disposed at a proximal end thereof. As perhaps better illustrated in FIGS. 6A and 6B, the plunger 138 extends from its proximal end into the collar 124 where it terminates at a distal end. The distal end of the plunger interfaces with a spring disposed within the collar 124. The plunger 138 can rest on an uncompressed spring 140*a* (as shown in FIG. 6A). The plunger 138 can also be depressed within the collar 124, compressing the spring 140*b* (as shown in FIG. 6B).

Proximate the distal end of the plunger 138 is a recess 142 in the body of the plunger 138. The axial movement of the plunger 138 within the collar 124 compresses and decompresses the spring (140*b* and 140*a*, respectively) and acts to move the recess 142 into and out of position beneath the retractable engagement members 136, 136*a*. That is, in some embodiments, as the plunger 138 compresses the spring 140*b*, the recess 142 moves into position beneath the retractable engagement members 136, 136*a*. The retractable engagement members 136, 136*a* can then be positioned (whether by physical depression into the recess 142 or by falling therein by the force of gravity) within the recess 142. As shown in FIG. 6B, the recess 142 is an annular channel sized and shaped to accommodate the retractable engagement members 136, 136*a* such that the retractable engagement members 136, 136*a* do not substantially protrude from the sidewall defining the openings 134, 134*a* or otherwise interfere with the cylindrical key body 124 traversing the bore 118 of the tamper-resistant lock 102 when positioned within the recess 142. Similarly, when the compressive force is removed from the plunger 138 and spring 140*b*, the spring pushes the plunger 138 directionally away, causing misalignment of the recess 142 with the retractable engagement members 136, 136*a*. This movement also causes the retractable engagement members 136, 136*a* to at least partially protrude from corresponding openings 134, 134*a* in the sidewall of the cylindrical key body 126. Thus, in some embodiments, depressing and releasing the plunger 138 causes the retractable engagement members 136, 136*a* to transition between extended and retracted positions.

In some embodiments, the openings in the sidewall are initially made slightly larger than the retractable engagement members so the retractable engagement members may be freely placed through the opening and into the interior portion of the collar. After being placed through the opening, the opening is crimped to a smaller diameter, thereby preventing the retractable engagement member from fully transitioning back through the opening. In an exemplary embodiment, the engagement member is 1/8" in diameter, and the opening is 3/16" in diameter or larger. The engagement member is placed through the opening, and then, the opening is crimped to a diameter of 3/28" or less to prevent the engagement member from being dislodged therefrom. It should be appreciated, however, that other measurements are included within this disclosure and any of the aforementioned components can be sized and shaped in any reasonable dimension to achieve the same result.

Figure 7:
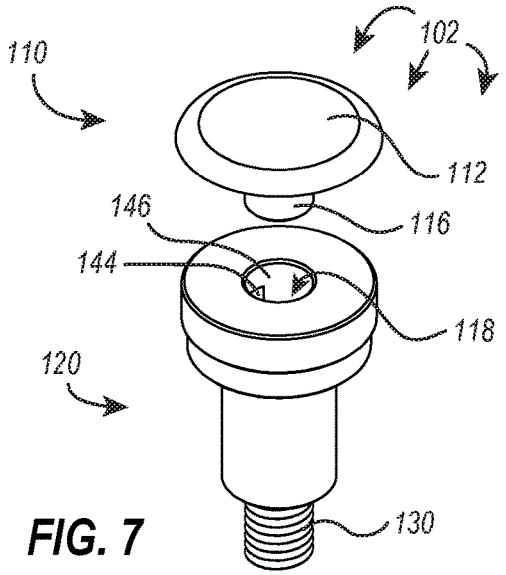
FIG. 7 illustrates a cylindrical lock body and bore cap of an exemplary tamper-resistant lock.
Figure 8A:
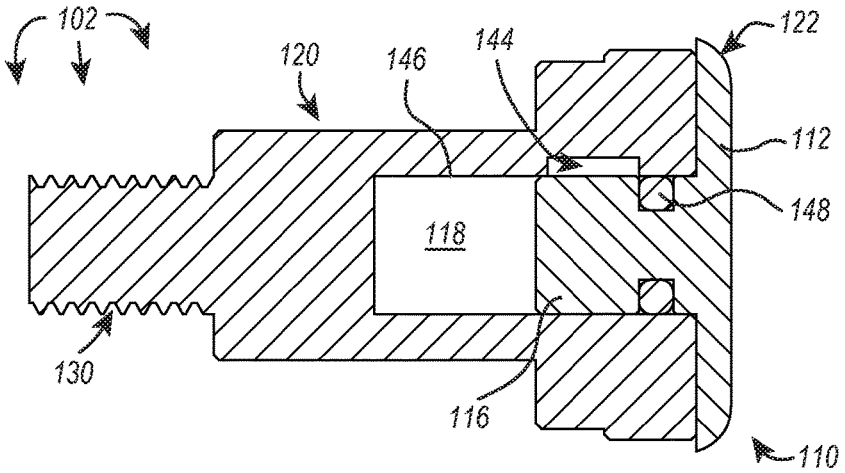
FIG. 8A illustrates a cross-section of the exemplary tamper-resistant lock of FIG. 7 with the bore cap associated with the cylindrical lock body.
Figure 8B:
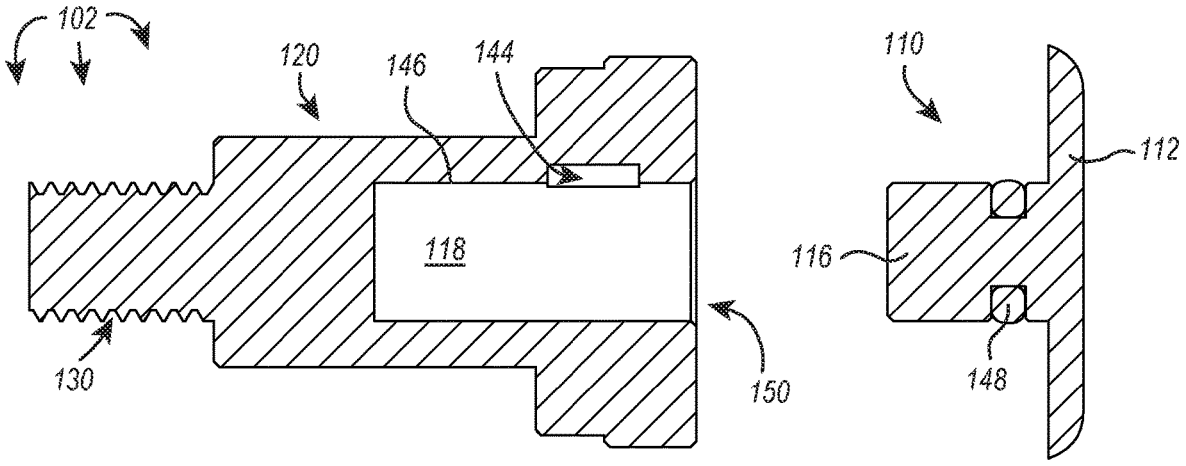
FIG. 8B illustrates a cross-section of the exemplary tamper-resistant lock of FIG. 7 with the bore cap removed from the cylindrical lock body, revealing the bore opening.

Referring now to FIGS. 7, 8A, and 8B, illustrated is a tamper-resistant lock 102 in a perspective view (FIG. 7) and cross-sectional views (FIGS. 8A and 8B). The tamper-resistant lock 102 includes a cylindrical lock body 120 having a bore 118 defined by an interior sidewall 146 thereof in at least a portion of a length thereof having external threads 130. As illustrated, the lower end of the cylindrical lock body 120 includes external threads 130 and is also smaller in diameter than the cylindrical body 120. It should be appreciated, however, that in some embodiments the cylindrical lock body may have a uniform diameter or may comprise a non-cylindrical shape (e.g., a rectangular prism, other three-dimensional polygonal and/or arcuate shapes, or combinations thereof).

The cylindrical lock body 120 may additionally include one or more engagement features 144 disposed and/or formed into the interior sidewall 146 of the bore 118. In some embodiments, the engagement feature 144 is sized and shaped to receive one or more retractable engagement members of a corresponding key. In an embodiment, the engagement feature can be an elongate channel having a semicircular, concave surface. In another embodiment, the engagement feature can be a depression within the sidewall that corresponds to and/or complements the size and/or shape of the retractable engagement member on a corresponding key. It should be appreciated that each engagement feature 144 is disposed a particular distance away from the opening 150 of the bore 118, and in some embodiments, that particular distance corresponds to the distance that a retractable engagement member is positioned along the cylindrical key body when the cylindrical key body is associated with the bore.

The tamper-resistant lock 102 also includes a bore cap 110 having a head 112 and a stem 116. As shown in FIG. 8A, the stem 116 is sized and shaped to fit within the bore 118, and in some embodiments, the bore cap 110 additionally includes a sealing member 148. In some embodiments, the sealing member 148 is an annular sealing member, such as an O-ring and acts to secure the bore cap 110 within the bore 118. When the bore cap 110 is associated with the bore 118, the sealing member 148 can through an interference fit create a tight association between the bore cap 110 in the cylindrical lock body 120 such that the bore cap 110 cannot be readily removed from the bore 118. As shown in FIG. 8A, the sealing member 148 can be positioned on the stem 116 at a location where it does not interfere with and/or interface with an engagement feature 144.

In some embodiments, the diameter and/or material of the sealing member can be adjusted, as known in the art, to increase or decrease the friction between the bore cap 110 and the interior sidewall 146 of the bore 118. For example, a sealing cap having a sealing member with a smaller diameter will likely require less force to disassociate from the cylindrical lock body than a bore cap having a sealing member with a larger diameter. In some embodiments, a plurality of sealing members can be disposed on the stem of the bore cap to increase the force required to disassociate the bore cap from the cylindrical lock body. It should be appreciated that the number and type of sealing members used may be commensurate with the amount of force desired for disassociating the bore cap from the cylindrical lock body. A tighter fit may increase the tamper-resistant nature of the lock, as it would be more difficult to remove the bore cap without the appropriate equipment.

In some embodiments, at least a portion of the bore cap 110 (e.g., the cap head 112) is made from a ferrous metal that responds to a magnetic field such that the bore cap 110, when interfaced with a magnet of sufficient strength to overcome the retention force of the interference fit formed by the sealing member 148 and the interior sidewall 146 of the cylindrical lock body 120, can be removed using said magnet. In some embodiments, the bore cap can be removed by a magnet having a pull force of greater than 5 lbs., greater than 10 lbs., greater than 20 lbs., greater than 30 lbs., greater than 40 lbs., greater than 50 lbs., greater than 75 lbs., greater than 100 lbs., or more.

Once the bore cap is removed from the cylindrical lock body, the bore opening is revealed (see, for example, FIG. 8B). However, in the event that an unauthorized individual removes the bore cap from the locking system or if the bore cap is inadvertently removed therefrom, the exposed bore is—at least at first blush—a round/arcuate hole with no readily visible elements that can be engaged with traditional tools (e.g., a screwdriver, a wrench, etc.). Partially hidden on the sidewall of the cylindrical lock body is a recess (see, for example, recess 144 of FIGS. 9A and 9B). The recess can be engaged by a bit or engagement member disposed on a specialized key, which when engaged therewith can provide a user with sufficient leverage to disengage the cylindrical lock body from its corresponding lock anchor.

Figure 9A:
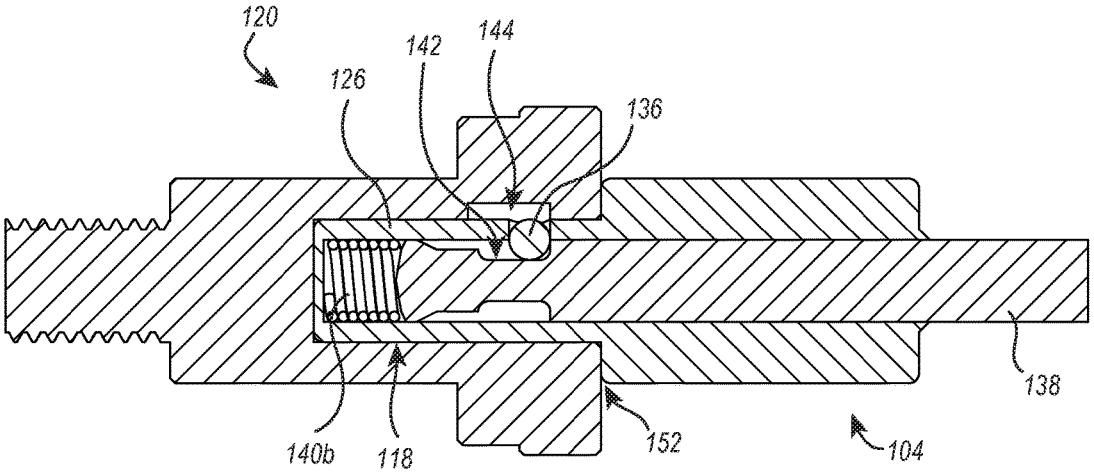
FIG. 9A illustrates an exemplary key associated with the cylindrical body of an exemplary tamper-resistant lock with the internal spring of the key being in a compressed state and the engagement member depressed within a recess of the plunger.
Figure 9B:
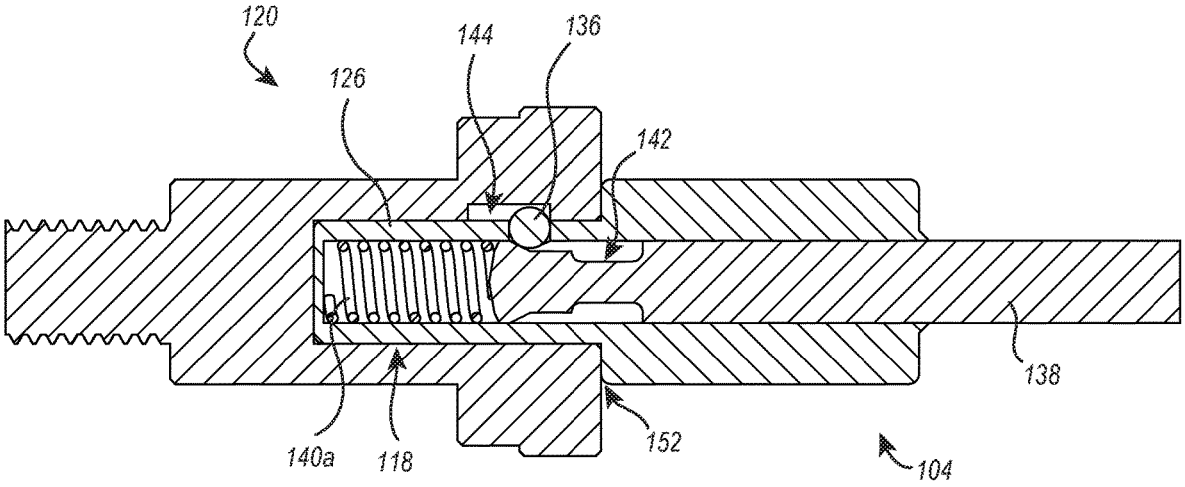
FIG. 9B illustrates the exemplary key, tamper-resistant lock of FIG. 9A with the internal spring of the key being in a decompressed state and the engagement member protruding into the engagement feature of the bore sidewall.

FIGS. 9A and 9B illustrate such an association, and more particularly illustrate the retractable engagement member 136 engaging with the engagement feature 144 of the cylindrical lock body 120. As shown in FIG. 9A, the plunger 138 is depressed, compressing spring 140*b*, in moving recess 142 and positioned beneath retractable engagement member 136. As the cylindrical key body 126 enters the bore 118, the retractable engagement member 136 can be depressed so as to not impede progress of the cylindrical key body 126 into the bore 118. Once the retractable engagement member 136 passes the opening of the bore 118 the plunger 138 can be released (as shown in FIG. 9B). The energy stored in the compressed spring 140*b* is released, pushing the plunger 138 axially away from the bore 118 and causing the recess 142 to be misaligned with the retractable engagement number 136. In turn, the retractable engagement member 136 is moved into an extended position within the engagement feature 144.

In some embodiments, the cylindrical key body 126 can be inserted into the bore 118 in a rotational configuration where the retractable engagement member(s) 136 are out of alignment with corresponding engagement feature(s) 144. The cylindrical key body 126 can be rotated within the bore 118 until the retractable engagement member(s) 136 are properly aligned with their corresponding engagement feature(s) 144. In some embodiments, the pressure of the retractable engagement member 136 pressing against the interior sidewall 146 of the bore 118 (in an unaligned configuration) is sufficient to prevent the plunger 138 from fully extending axially away, and upon proper alignment, the retractable engagement member 136 can snap into position within its corresponding engagement feature 144, finally allowing the plunger 138 and/or spring 140*a* to fully extend. In this way, a key having an improper configuration of retractable engagement members with respect to corresponding engagement features of the lock body cannot be used to engage the lock body, even if a single retractable engagement member is misaligned. A misaligned retractable engagement member will press against the interior sidewall of the bore and prevent the plunger from returning to a position that allows the cylindrical key body (e.g., the retractable engagement members) to securely engage the cylindrical lock body (e.g., the engagement features). As such, the cylindrical key body would rotate inside the bore without gaining sufficient purchase to rotationally disengage the cylindrical lock body.

In some embodiments, the key 104 includes a flange 152 positioned adjacent the cylindrical key body 126. The flange 152 can abut against a top surface of the cylindrical lock body 120, stopping progress of the cylindrical key body 126 within the bore 118. This can aid in the alignment of retractable engagement members 136 with their corresponding engagement feature 144, as the cylindrical key body 126 will enter the bore 118 a defined distance when the flange 152 and the top surface of the cylindrical lock body 120 interact and prevent further axial movement. Accordingly, the axial distance between the opening 150 of the bore 118 and engagement feature 144 will substantially correspond to the axial distance between the flange 152 and the corresponding retractable engagement member 136 on a complementary key 104. The proper rotational alignment can then easily be found by implementing a clockwise or counterclockwise rotation of the cylindrical key body.

In some embodiments, the key does not include a flange or the flange does not impede axial progress of the cylindrical key body was in the bore. Rather, the cylindrical key body extends all the way into the bore and bottoms out on the surface of the cylindrical lock body sidewall that defines the bottom edge of the bore, thereby halting its axial progress within the bore. The retractable engagement members and corresponding engagement features can they be measured and/or defined by a particular distance away from terminal, distal end of the cylindrical lock body and the bottom edge of the bore, respectively.

In some embodiments, and as shown in FIGS. 9A and 9B, the cylindrical key body 126 is sized and shaped to fit within a complementary bore 118 of the cylindrical lock body 120 such that axial movements in and out of the bore 118 are permitted and lateral movements within the bore 118 are reduced. This may be enabled by making the diameter of the bore 118 slightly larger than the diameter of the cylindrical key body 126. For example, the diameter of the bore may be manufactured with an upper threshold tolerance such that the diameter of the bore is no more than 5 mm larger than the diameter of the cylindrical key body, no more than 2.5 mm larger than the diameter the cylindrical key body, no more than 1 mm larger than the diameter of the cylindrical key body, no more than 0.9 mm larger than the diameter of this cylindrical key body, no more than 0.8 mm larger than the diameter the cylindrical key body, no more than 0.7 mm larger than the diameter of the cylindrical key body, no more than 0.6 mm larger than the diameter of the cylindrical key body, no more than 0.5 mm larger than the diameter of the cylindrical key body, no more than 0.4 mm larger than the diameter the cylindrical key body, no more than 0.3 mm larger than the diameter of the cylindrical key body, no more than 0.2 mm larger than the diameter to cylindrical key body, no more than 0.1 mm larger than the diameter of the cylindrical key body, no more than 0.75 mm larger than the diameter of the cylindrical key body, no more than 0.50 mm larger than the diameter of cylindrical key body, no more than 0.25 mill meters larger than the diameter the cylindrical key body, or no more than 0.1 mm larger than the diameter the cylindrical key body, and the diameter of the bore may be manufactured with a lower threshold tolerance such that the diameter of the bore is no less than 0.01 mm larger than the diameter of the cylindrical key body, no less than 0.25 mm larger than the diameter of cylindrical key body, no less than 0.5 mm larger than the diameter the cylindrical key body, no less than 0.75 mm larger than the diameter of the cylindrical key body, no less than 0.1 mm larger than the diameter of the cylindrical key body, no less than 0.2 mm larger than the diameter of the cylindrical key body, no less than 0.3 mm larger than the diameter the cylindrical key body, no less than 0.4 mm larger than the diameter of cylindrical the body, no less than 0.5 mm larger than the diameter the cylindrical key body, no less than 0.6 mm larger than the diameter of the cylindrical key body, no less than 0.7 mm larger than the diameter of cylindrical key body, no less than 0.8 mm larger than the diameter of this cylindrical key body, no less than 0.9 mm larger than the diameter the cylindrical key body, no less than 1 mm larger than the diameter of the cylindrical key body, no less than 2.5 mm larger than the diameter of cylindrical key body, no less than 5 mm larger than the diameter of the cylindrical key body, or any tolerance range selected using any of the foregoing upper and lower bounds.

It should be appreciated that while the ranges and bounds of manufacturing tolerances provided above were recited from the perspective of drilling (or otherwise forming) the bore, similar manufacturing tolerances can be used when manufacturing the cylindrical key body. Obviously, however, the recited manufacturing tolerances above will be inverted, as appropriate, such that the cylindrical key body is manufactured to be smaller in diameter than that of the bore (e.g., the cylindrical key body having a diameter that is at least less than 0.1 mm smaller than the diameter of the bore and no more than 1 mm smaller than the diameter of the bore).

Figure 10A:
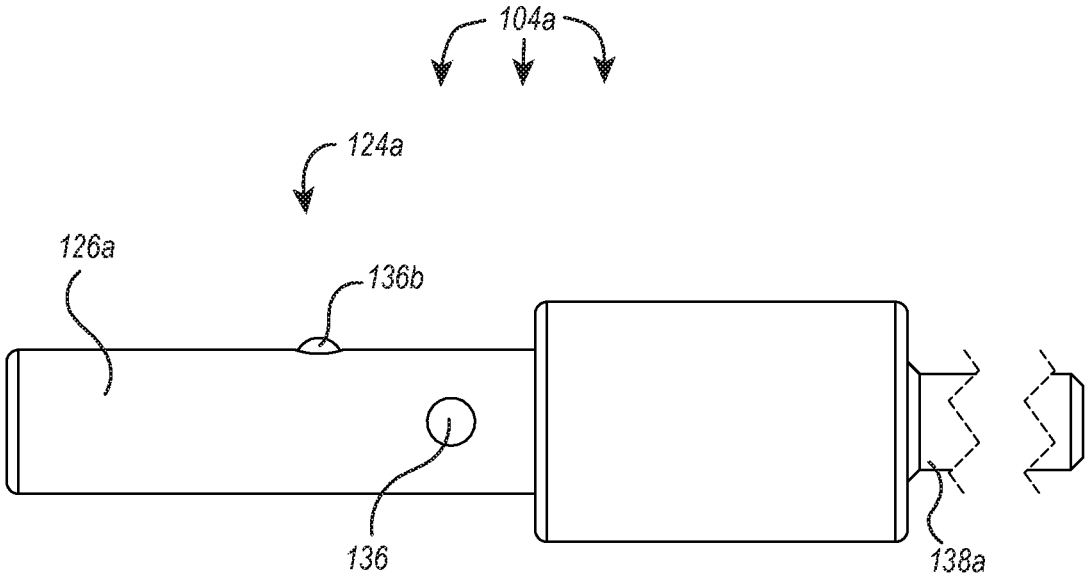
FIG. 10A illustrates another exemplary key having two offset engagement members.
Figure 10B:
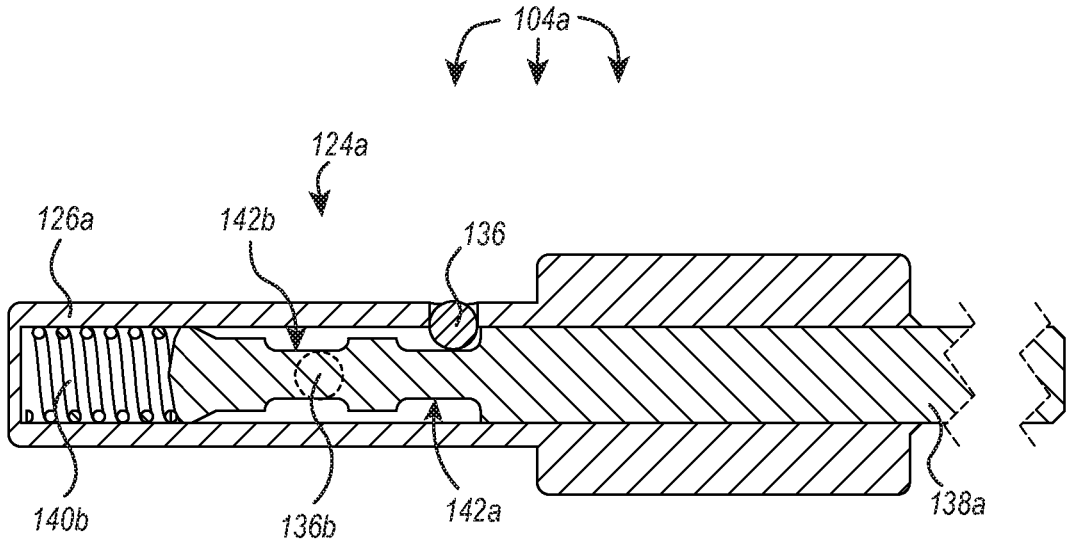
FIG. 10B illustrates a cross-sectional view of the key of FIG. 10A.

In some embodiments, and as shown in FIGS. 10A and 10B, a key 104*a* can include a plurality retractable engagement members 136, 136*b* disposed along the cylindrical key body 124*a*. For example, a second retractable engagement member 136*b* can be positioned in a different orthogonal cross-section from the first retractable engagement member 136. FIG. 10B illustrates a cross-section of the key 104*a* of FIG. 10A, rotated 90° counterclockwise. As shown in FIG. 10B, the key 104*a* includes a plunger 138*a* that has a two recesses 142*a*, 142*b*, one associated with each retractable engagement member 136, 136*b*. Accordingly, the plunger 138*a* is depressed (as shown in FIG. 10B), the recesses 142*a*, 142*b* are positioned beneath the retractable engagement members 136, 136*b*, and the retractable engagement members 136, 136*b* can be depressed within its corresponding opening as described above.

As shown in FIG. 10B, the recesses 142*a*, 142*b* can be annular recesses that can accommodate a retractable engagement member positioned within any orthogonal cross-section of the cylindrical key body 126*a* that overlaps the recess. Accordingly, the plunger 138*a* does not have to be locked in a single rotational plane because the annular recess makes all rotational positions available to receive a corresponding retractable engagement member. In some embodiments, however, the recess is not an annular recess. Rather, the recess is a scoop and/or divot that is axially aligned with its corresponding retractable engagement member.

In some embodiments, the number and positioning of retractable engagement members is greater and/or different than that shown in FIGS. 10A and 10B. For example, a key may include a plurality of retractable engagement members that are axially aligned and/or within the same orthogonal cross-section. Additionally, or alternatively, a key may include a plurality of retractable engagement members where at least two retractable engagement members are not axially aligned and/or within the same orthogonal cross-section.

Figure 11:
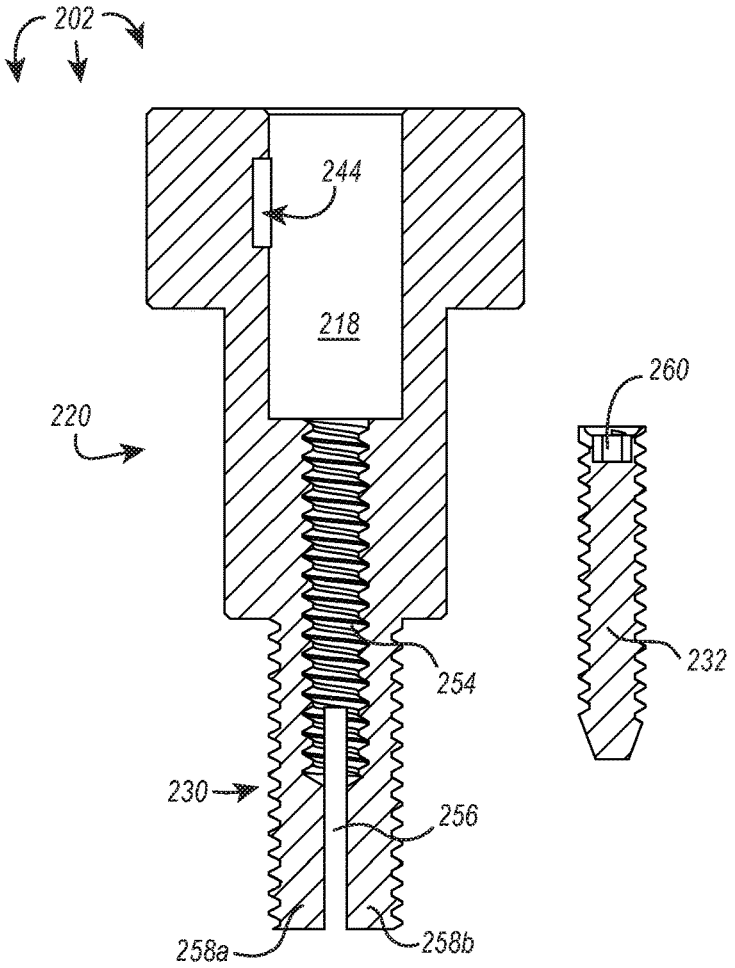
FIG. 11 illustrates an exemplary tamper-resistant lock having a split shaft and a lock anchor.

Referring now to FIG. 11, illustrated is an exemplary tamper-resistant lock 202 having a split shaft 258*a*, 258*b* and a lock anchor 232. Many components of the tamper-resistant lock 202 are substantially similar to the tamper-resistant lock 102 described above. For example, the tamper-resistant lock 202 includes a cylindrical lock body 220 having a bore 218 and an engagement feature 244 that is defined by the sidewall of the bore 218, and analogous structures were described above with respect to the tamper-resistant lock 102. Additionally, the tamper-resistant lock 202 includes external threads 230 on a portion of the length of the cylindrical lock body 220.

However, the portion of the cylindrical lock body 220 that includes external threads 230 has been split, forming a split shaft 258*a*, 258*b*, whereas the cylindrical lock body 120 described above at a uniform, unsplit shaft. The cylindrical lock body 220 additionally includes an anchoring member 254 that spans in an axial direction from the sidewall defining the bottom surface of the bore 218 to the split shaft 258*a*, 258*b*. In some embodiments, and as depicted in FIG. 11, the anchoring member 254 includes a threaded bore, the threads being complementary to threads found on the lock anchor 232.

In some embodiments, the lock anchor 232 can be driven into the anchoring member 254, which causes each arm 258*a*, 258*b* of the split shaft to bias outward. If the external threads are fastened and/or engaged within the housing (e.g., by complementary threads of a housing anchor) when the lock anchor 232 is driven into the anchoring member 254, the arms 258*a*, 258*b* of the split shaft will bias outward against the housing anchor to functionally lock the cylindrical lock body 220 in its current location. In some embodiments, the cylindrical lock body 220 cannot be rotated in any direction until the lock anchor 232 is removed.

As shown in FIG. 11, the lock anchor 232 includes a bit port 260. The bit port 260 is illustrated as being configured to receive a hex key. However, the bit port can have any number or type of configurations including, for example, an X-shaped socket for receiving a Phillips screwdriver. In some embodiments, the bit port is functionally equivalent to a hexagonally-shaped head on the lock anchor.

Figure 12:
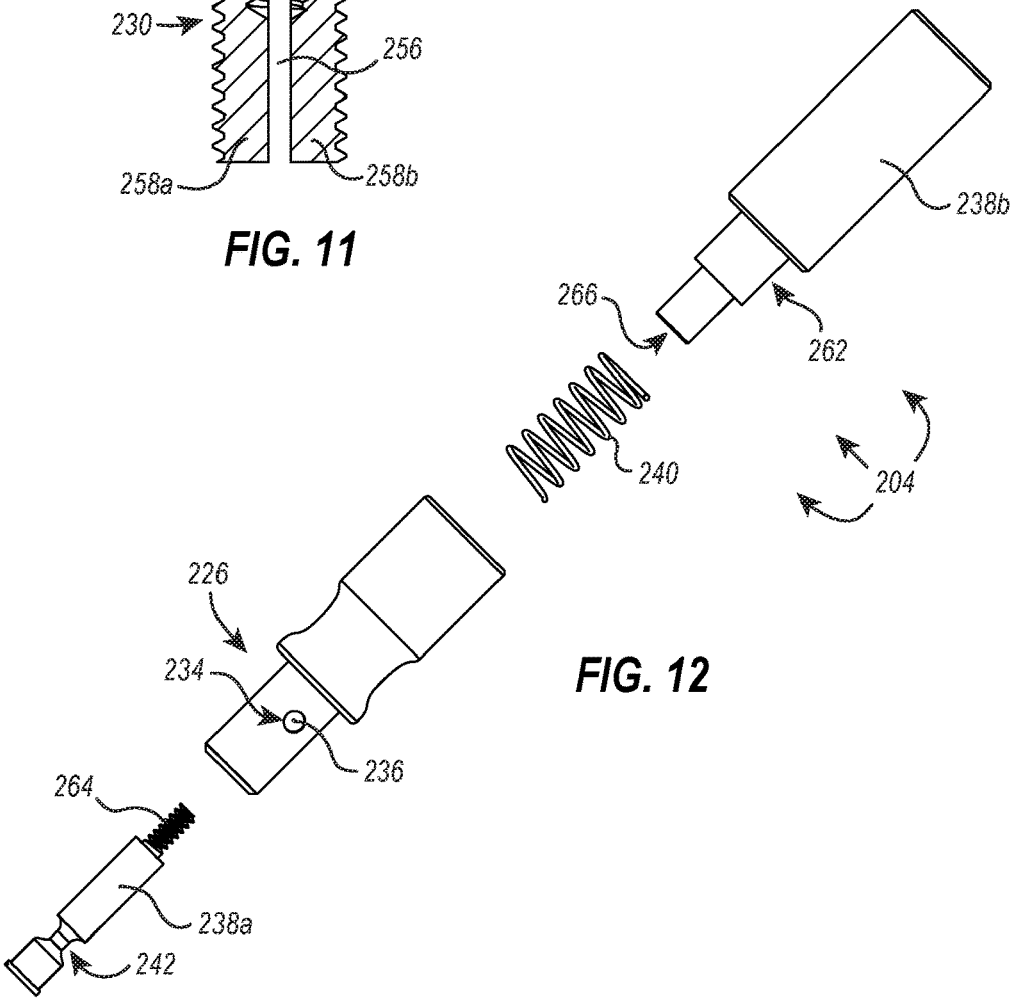
FIG. 12 illustrates an exploded view of another exemplary key.

Referring now to FIG. 12, illustrated is an exploded view of an alternative key 204 that functions in an analogous way to the key 104 discussed above. The key 204 includes a lower plunger piece 238*a* that threadedly connects to an upper plunger piece 238*b* through the cylindrical key body 226. The alternative key 204 includes a collar sidewall that defines an opening 234 through which a retractable engagement member 236 is positioned. The spring 240 of the alternative key 204 is positioned to at least partially surround a collar 262 of the upper plunger piece 238*b* and extend into an interior portion of the cylindrical key body 226. Depression of the upper plunger piece 238*b* causes compression of the spring 240 and movement of the lower plunger piece 238*a* into a position beneath the retractable engagement member 236—functioning in an analogous way to the key 104 disclosed above.

Locking Systems Incorporating Lock Anchors Within the Tamper-Resistant Lock

The locking systems described above in FIGS. 1-4 could be used in some embodiments as a retrofit to many existing housing elements (e.g., many electrical boxes have a similar configuration but use hex bolts in place of the tamper-resistant lock). In some embodiments, the housing element may need to be replaced or fitted with a different lid. An exemplary locking system is disclosed in FIGS. 13-16 that can be used as a retrofit to existing housings or as an entirely new housing and integrated locking system altogether.

Figure 13:
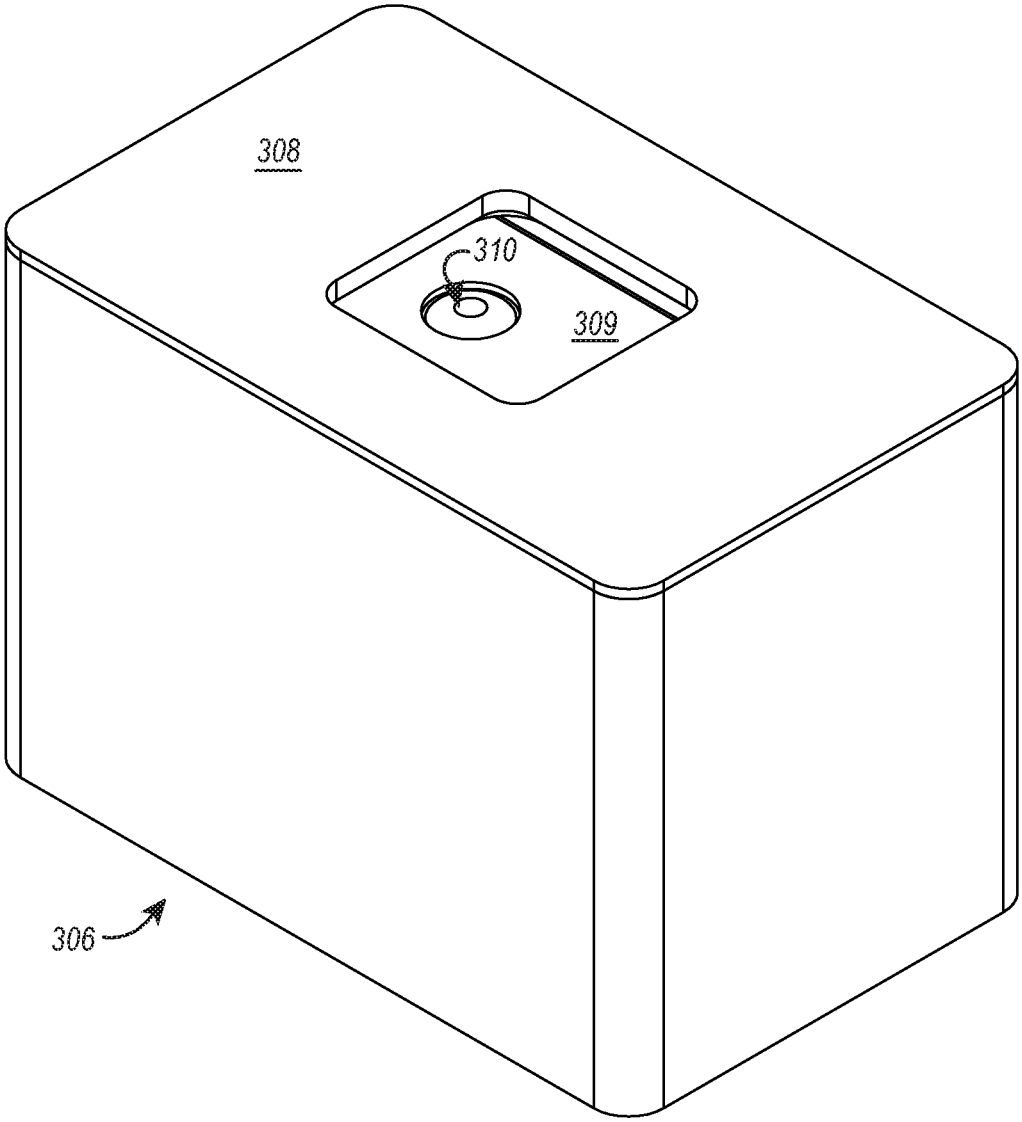
FIG. 13 illustrates an exemplary locking system securing a lid to a housing.

FIG. 13 illustrates an assembled locking system that is securing a lid 308 to housing 306. In an assembled state, the only viewable components are the housing 306, the lid 308, the inner lid 309, and the head of a bore cap 310. The inner lid 309 is recessed within the lid 308 and pressed firmly there against leaving no discernible gap between the two lids 308, 309. The bore cap 310 is similar in shape and function as the bore caps described above. For example, the bore cap 310 includes a head with the beveled edge that is at least partially recessed within the inner lid 309 to prevent tampering and/or leveraging of the bore cap 310 away from the inner lid 309.

Figure 14:
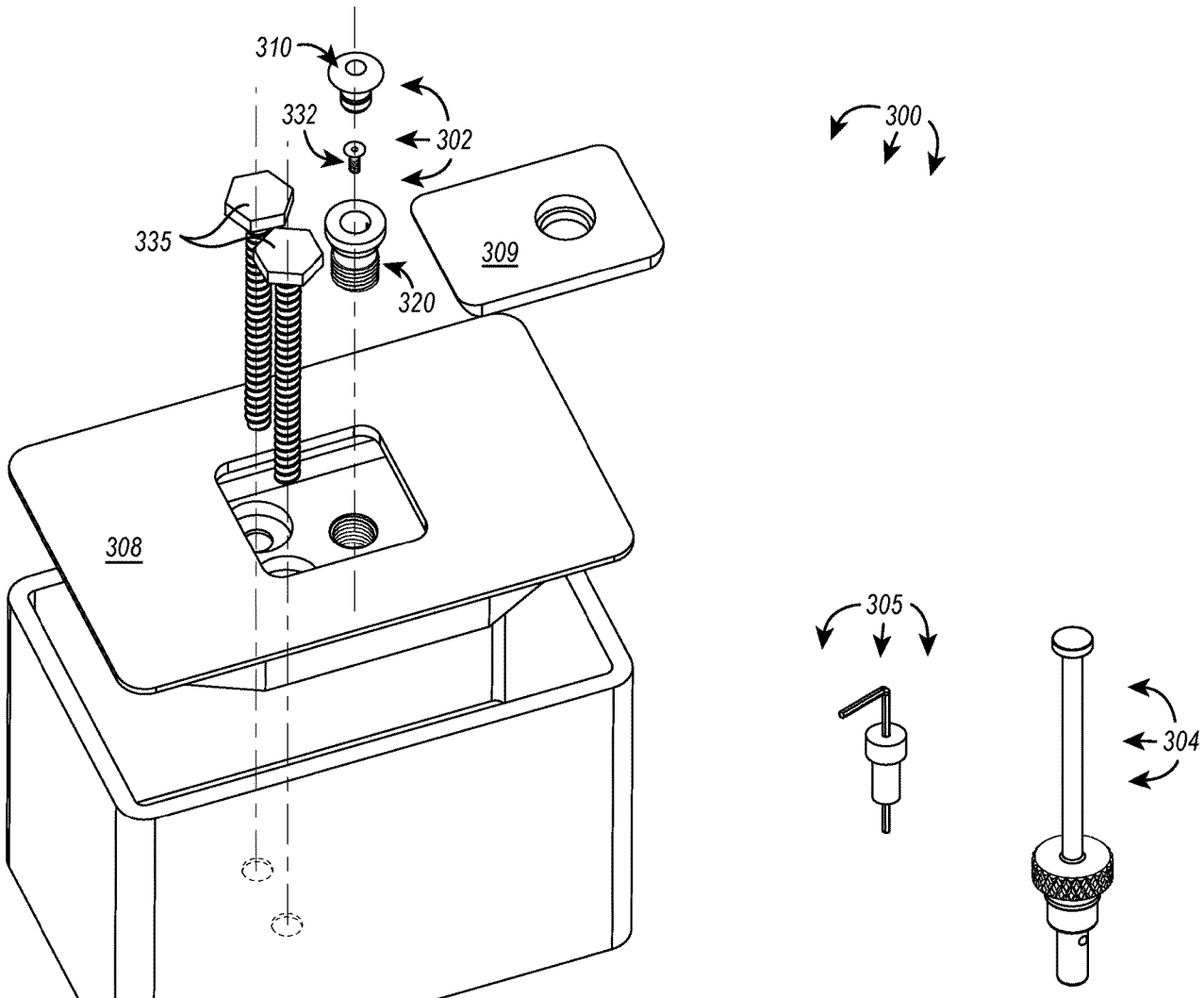
FIG. 14 illustrates an exploded view of the exemplary locking system and housing of FIG. 13.

FIG. 14 illustrates an exploded view of the exemplary locking system 300 and housing 306 of FIG. 13. As shown, the lid 308 is secured to the housing 306 by a plurality of securing members 335 that threadedly engage the housing 306 or an anchor associated therewith. The securing members 335 are depicted in FIG. 14 as threaded bolts having a hexagonally shaped head, although it should be appreciated that the securing members can have any shape or configuration known in the art. In some embodiments, only a single securing member 335 is used to secure the lid 308 to the housing 306.

As further shown in FIG. 14, the inner lid 309 is secured to the lid 308, thereby concealing securing members 335, with a tamper-resistant lock 302. The cylindrical lock body 320 of the tamper-resistant lock 302 passes through an opening in the inner lid 309 and threadedly engages the lid 308. A flange associated with the cylindrical lock body 320 engages a ledge on the inner lid 309 to lock the inner lid 309 onto lid 308. As described in more detail below, attachment mechanism 332 further secures/anchors the cylindrical lock body 320 to the lid 308, and as described above, the bore cap 310 can associate with the cylindrical lock body 320 to occlude its opening. The locking system 300 additionally includes a key 304 and a second key 305 configured in size and shape to engage one or more components of the tamper-resistant lock 302.

Figure 15A:
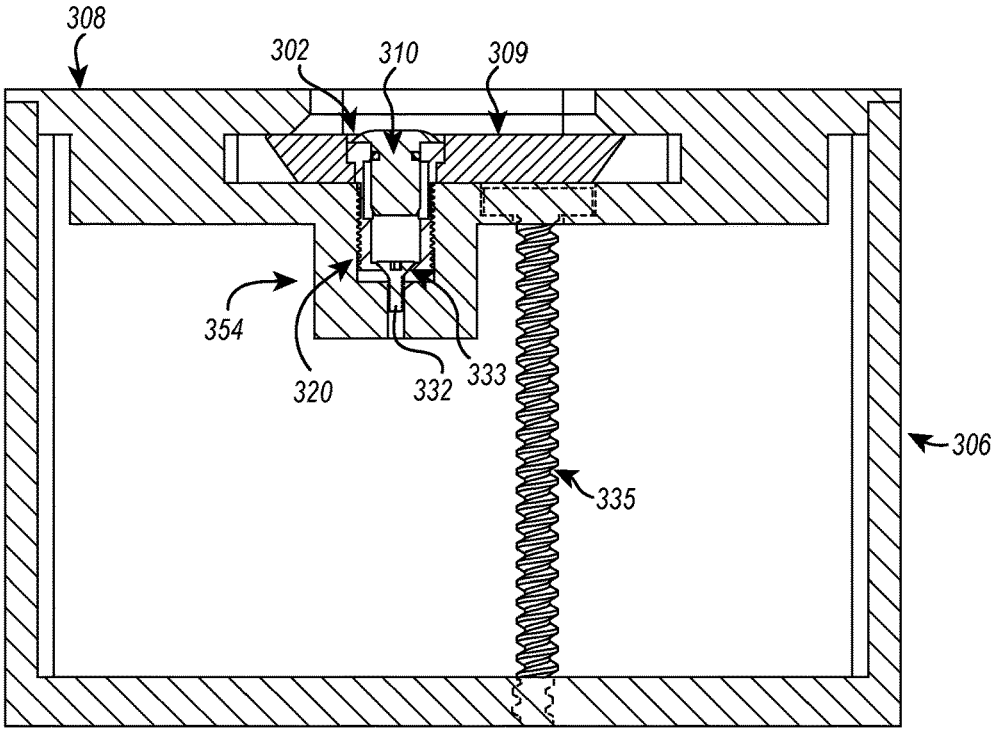
FIG. 15A illustrates a cross-section of the locking system and housing of FIG. 13 with the locking system fully locked.
Figure 15B:
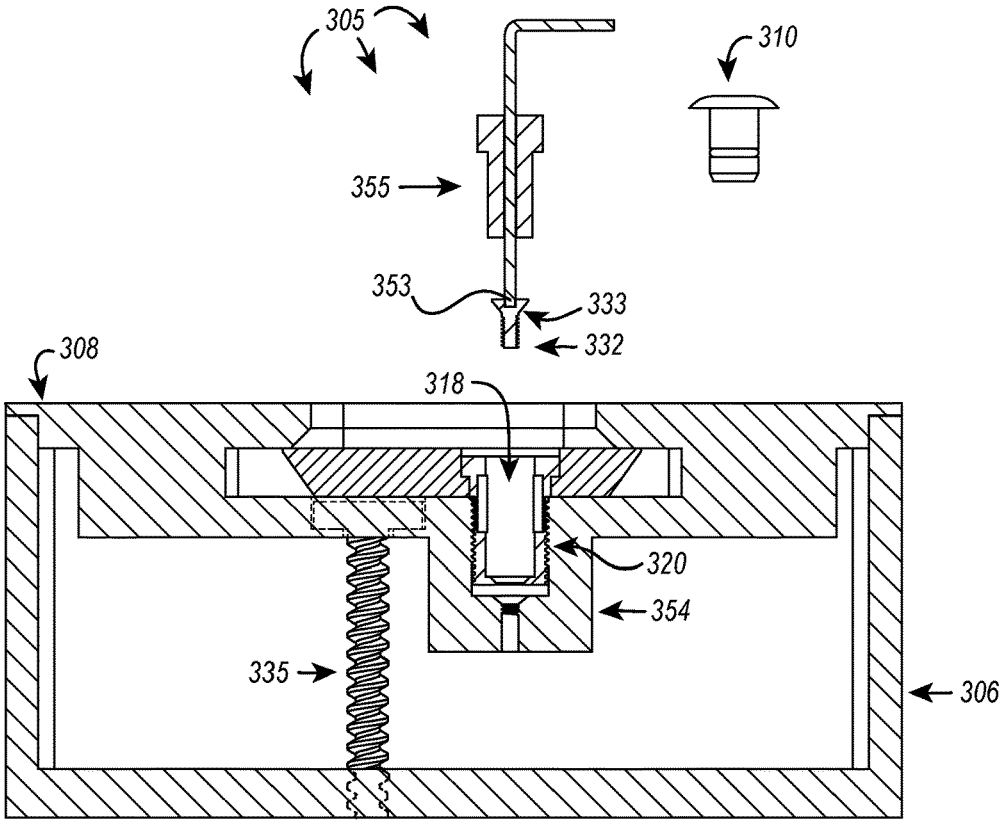
FIG. 15B illustrates a cross-section of the locking system and housing of FIG. 13 with the bore cap and lock anchor removed.
Figure 15C:
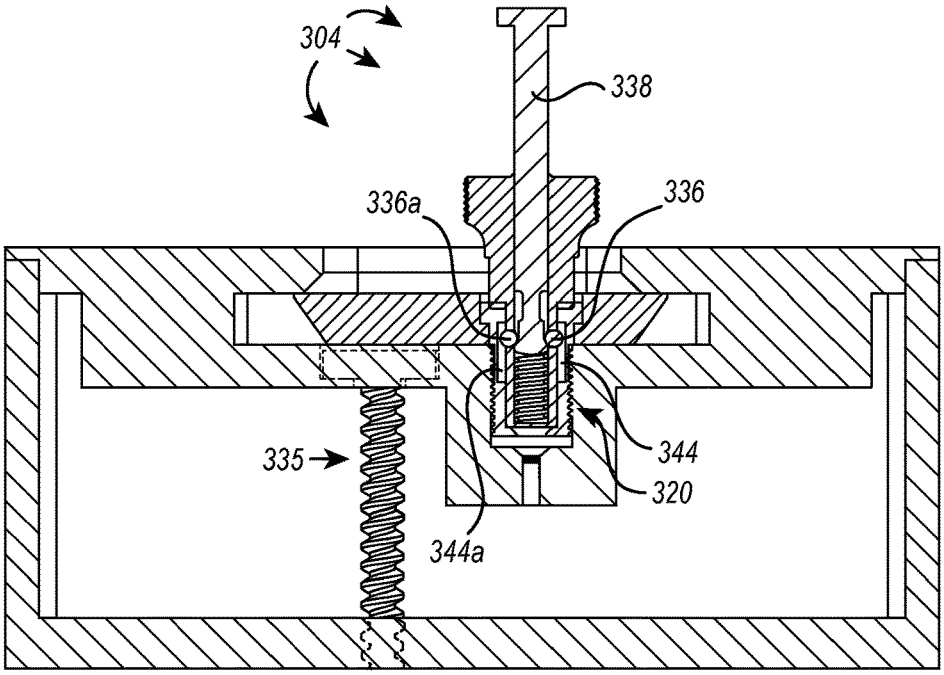
FIG. 15C illustrates a cross-section of the locking system and housing of FIG. 13 with the key engaging the cylindrical lock body.

FIGS. 15A-15C illustrate cross-sections of the housing 306 and associated locking system 300 of FIGS. 13 and 14 in progressive stages of engagement by key 304 and second key 305 for disengaging the tamper-resistant lock 302.

FIG. 15A illustrates a cross-section of the housing 306 and locking system 300 as shown in FIG. 13. As shown, the securing member 335 retains the lid 308 in secure communication with housing 306. The inner lid 309 acts to occlude the securing member 335 from view and/or prevent direct tampering. The lid 309 is secured to and locked to lid 308 by tamper-resistant lock 302. Tamper-resistant lock 302 is similar in many respects to the tamper-resistant locks described above. For example, the bore cap 310 is substantially similar to the bore caps described above—both with respect to structure and function. The cylindrical lock body 320 is also similar to the cylindrical lock bodies described above—both with respect to structure and function. As illustrated, the cylindrical lock body 320 acts to secure the inner lid 309 to the lid 308.

However, the cylindrical lock body 320 has an additional feature not previously described above. The cylindrical lock body 320 is associated with a lock anchor for selectively securing the cylindrical lock body 320 to an anchoring member 354 (e.g., the lid 308). The lock anchor is illustrated as an attachment mechanism 332 that selectively couples the lower end of the cylindrical lock body 320 to the lid 308, and in some embodiments, and as illustrated in FIG. 15A, the attachment mechanism is a bolt that threadedly engages the lid 308 at an anchoring position (e.g., a complementary threaded bore on the lid 308). The head 333 of the attachment mechanism 332 can have any shape or configuration. However, as illustrated in FIG. 15A, the head 333 is configured to engage a hex key.

Referring now to FIG. 15B, the attachment mechanism 332 has been removed from its association with the cylindrical lock body 320. This can be accomplished as described above. As an exemplary illustration, the key 304 of FIG. 14 can include a magnet that can magnetically engage the bore cap 310; the bore cap 310 can then be pulled free from its association with the cylindrical lock body 320. As shown in FIG. 15B, the second key 305 can be used to engage and remove the attachment mechanism 332 from the anchoring member 354. The second key 305 can include a bit 353 that is sized and shaped to engage the head 333 of attachment mechanism 332. For example, the bit 353 can in some embodiments be a hex key. In some embodiments, the bit is X-shaped to accommodate a Phillips screwdriver, or it can be any other configuration or socket known in the art.

The second key 305 can additionally include a guide 355. In some embodiments, the guide 355 is sized and shaped to fit within the bore 318 defined by the cylindrical lock body 320, and in this way, it can more stably and/or accurately guide the bit 353 into communication with the attachment mechanism 332. In some embodiments, the guide includes a flange that regulates penetrative depth of the second key within the bore of the cylindrical lock body.

With the attachment mechanism 332 is removed, the cylindrical lock body 320 can now be engaged and removed using the key 304, as described above in FIGS. 1-10B. For example, FIG. 15C illustrates two retractable engagement members 336, 336*a* positioned within engagement features 344, 344*a*, respectively. The key 304 can then be rotated to unfasten the cylindrical lock body 320 from the lids 308, 309.

Figure 16:
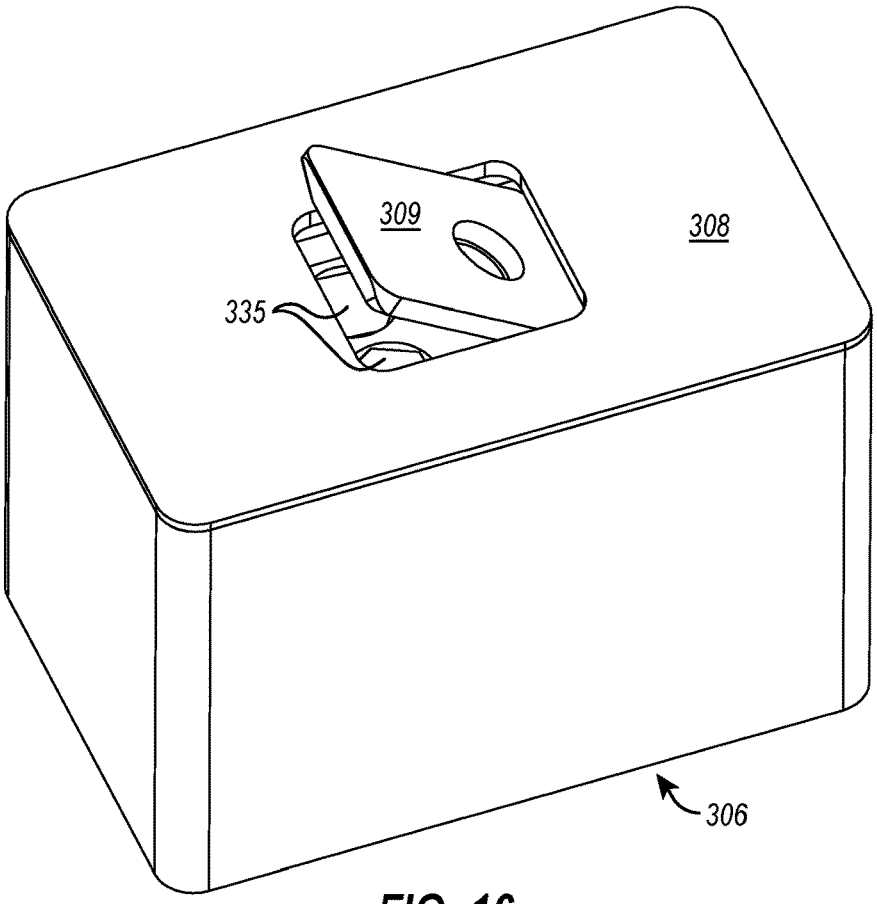
FIG. 16 illustrates the exemplary locking system and housing of FIG. 13 with the inner lid of the housing being opened.

Once the cylindrical lock body is removed, the inner lid 309 can be slid laterally until an edge can be removed through the lid 308 (as shown in FIG. 16). Removal of the inner lid 309 reveals securing member 335 which can now be engaged to loosen the lid 308 from its association with the housing 306. In some embodiments, the inner lid 309 is not removed from the lid 308. Rather, the inner lid 309 is moved laterally and/or pivoted to a position that reveals the securing members and allows them to be accessed and/or engaged for the removal of the lid 308.

Housing Adapters

Figure 17:
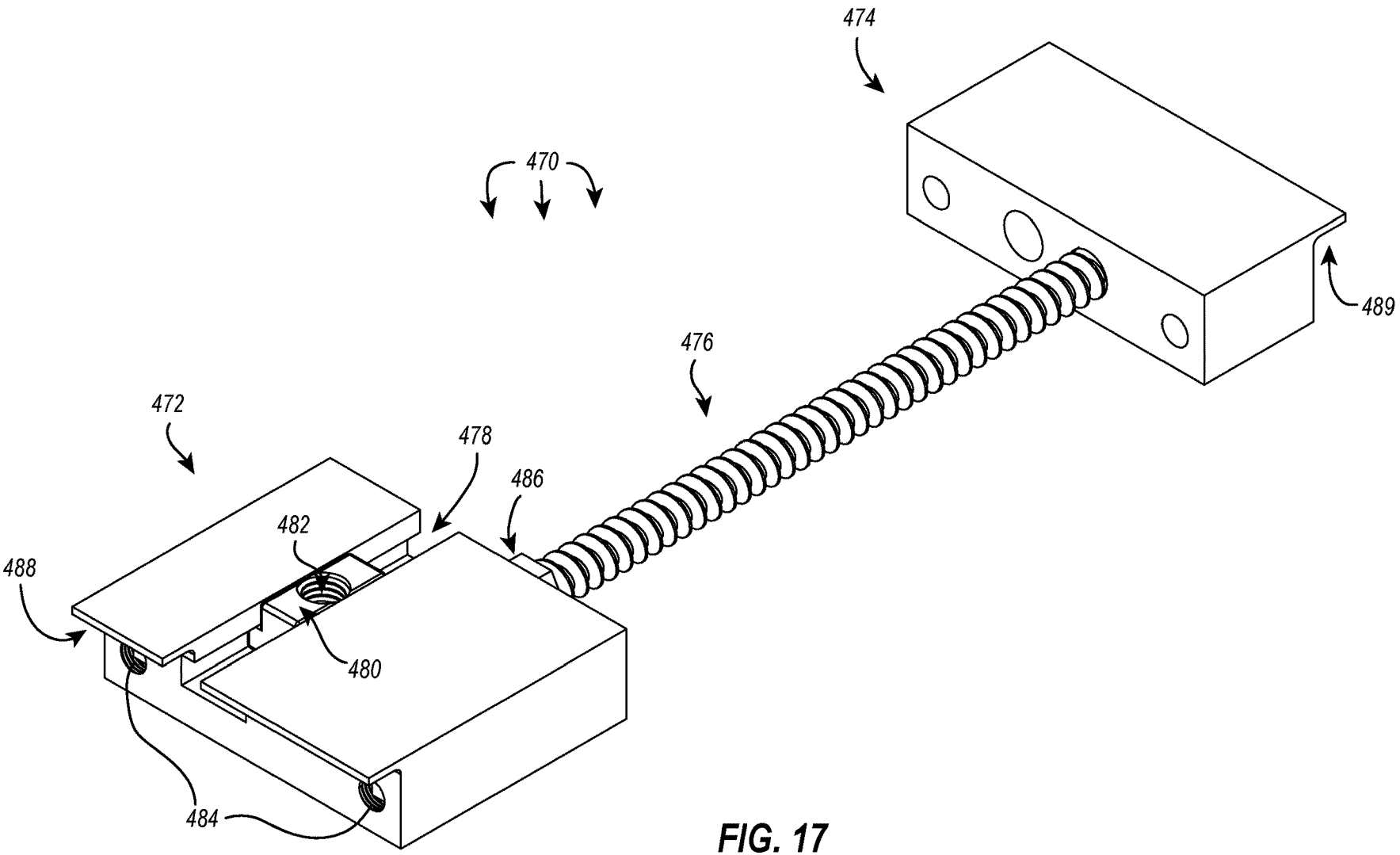
FIG. 17 illustrates an exemplary adjustable adaptor.
Figure 18:
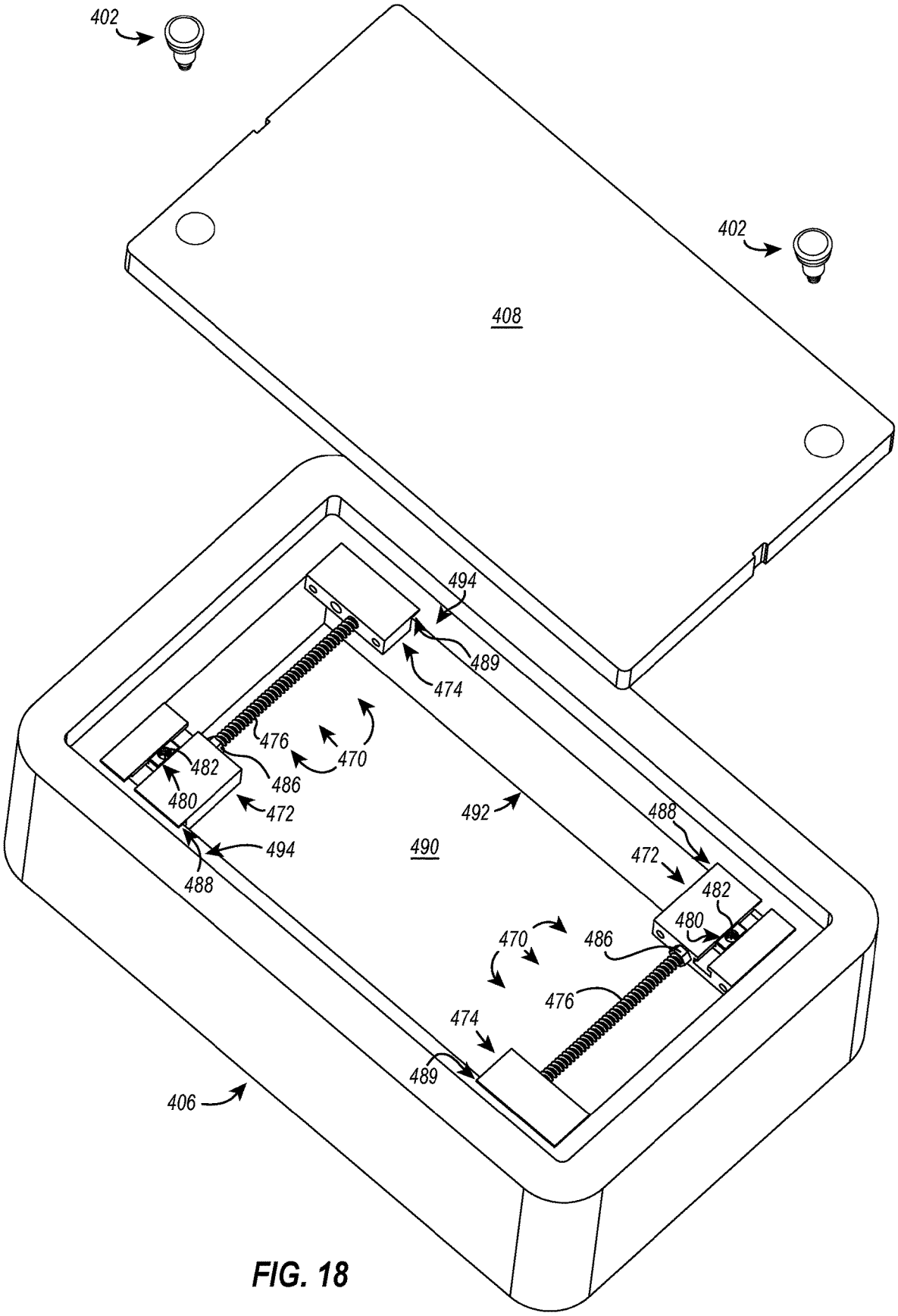
FIG. 18 illustrates a partially exploded view of a locking system and housing that incorporates adjustable adaptors.

In some implementations, particularly those implementations where a housing is retrofit with a locking system disclosed herein, the internal structure of the housing does not have the infrastructure necessary for implementing the locking system, greater versatility is desired when implementing the locking system, and/or additional securing features are desired. As shown in FIGS. 17 and 18, one or more housing adaptors 470 can be implemented within a housing 406 to receive and secure a tamper-resistant lock 402.

As shown in FIG. 17, a housing adapter 470 includes a first end 472 and a second end 474 separated by the first end 472 by an elongate member 476. As further illustrated in FIG. 17, the first end 472 has a channel 478 disposed therein, which can slidably receive a lock coupling member 480 that is sized and shaped to fit within the channel 478. The lock coupling member 480 can include a threaded bore 482 that is configured to, for example, receive external threads of a complementary tamper-resistant lock. In some embodiments, the lock coupling member includes any other attachment mechanism that may selectively secure a complementary tamper-resistant lock. In some embodiments, the channel within the first end additionally includes one or more anchoring members configured to receive a lock anchor that additionally secures a tamper-resistant lock (similar to that described above in FIGS. 13-16).

Also illustrated in FIG. 17, a first end 472 can include one or more selectively extendable rams 484. As illustrated, selectively extendable rams can rotatingly extend from the first end 472. In some embodiments, the selectively extendable rams can ratchet forward or may extend by any other means known in the art. The selectively extendable rams 484 of FIG. 17 are illustrated as having a pointed tip. The pointed tip may be advantageous as it can concentrate the force applied by the ram on a smaller area, which may make it more difficult to dislodge or move the adjustable adaptor 470 when the selectively extendable rams are in contact with an adjacent surface. In some embodiments, the selectively extendable rams include a flat or rounded tip.

It should be appreciated that although FIG. 17 illustrates only the first end 472 as having selectively extendable rams 484, the second end 474 can additionally, or alternatively, include one or more selectively extendable rams.

FIG. 17 illustrates an elongate member 476 that is threadingly received into the first and/or second ends 472, 474 of the adjustable adapter 470. In some embodiments, one of the first or second ends does not move with respect to the elongate member but is fixed on an end thereof. The other, unfixed end can slide and/or rotate along the elongate member to adjust the distance between the first and second ends. In some embodiments, a stopper is provided on the elongate member for fixing a distance between the first and second ends. As shown in FIG. 17, a stopper is a threaded nut 486 that can be rotated along the elongate member 476 to define a distance between the first and second ends 472, 474.

Referring now to FIG. 18, illustrated is an exemplary locking system with adapters 470 placed within an interior portion 490 of housing 406. A flange or lip 488, 489 of the first and second ends 472, 474 rest on an interior ledge 494 of the housing 406, allowing the adjustable adapters 470 to span the width of the interior portion 490 of the housing 406 in to be suspended near the opening of the housing 406. In some embodiments, the distance between the first and second ends of the adjustable adapters is adjusted so that the adjustable adapters can span a length of the housing. In some embodiments, one or more adjustable adapters span a width of the housing and/or one or more adjustable adapters span a length of the housing.

In some embodiments, the housing does not include an interior ledge. In such instances, or at the preference of the user, the adjustable adapters can be placed on the top edge of a sidewall of the housing with the adjustable adapter spanning a length and/or width of the housing.

Once the desired distance between the first and second ends 472, 474 is established, the adjustable rams (not shown in FIG. 18) can be extended to engage the sidewall of the housing (or another comparable component of the housing), thereby securing the adjustable adapter 470 in its selected location. In some embodiments, engaging a housing sidewall with a first selectively extendable ram is sufficient to hold the adjustable adapter in position. In some embodiments, engaging the housing sidewall with a second selectively extendable ram prevents one or more of a rotational, lateral, or vertical movement of the associated end or of the adjustable adapter, generally. In some embodiments, first and second selectively extendable rams are positioned on opposing sides of the first and/or second ends of the adjustable adaptor.

In some embodiments, the adjustable adapters 470 are placed within the interior portion 490 of the housing 406 such that the lock coupling member is substantially aligned with openings in the associated housing lid 408. Accordingly, when the lid 408 is placed on the housing 406, a tamper-resistant lock 402 can secure the lid to the housing 406 by engaging the lock coupling member 480. The tamper-resistant lock 402 can be shaped and/or function in a manner similar to those tamper-resistant locks disclosed above.

In an exemplary implementation, a tamper-resistant lock used with the adjustable adaptors described above includes a split shaft (e.g., as shown and described in FIG. 11). Upon engaging the threaded bore of the lock coupling member, the tamper-resistant lock can be further secured to the adjustable adapter by selectively driving a lock anchor into the split shaft (e.g., through the bore and anchoring member of the cylindrical lock body of the tamper-resistant lock).

It should be appreciated that although the first end of the adjustable adapter is the only end shown as having a lock coupling member, in some embodiments, both the first and second ends include lock coupling members. Additionally, or alternatively, the channels that receive the lock coupling member may be positioned at different angles and/or orientations within the first and/or second ends of the adjustable adapter. In some embodiments, there are multiple channels disposed in one or more orientations within the first and/or second ends of the adjustable adapter.

Figure 19:
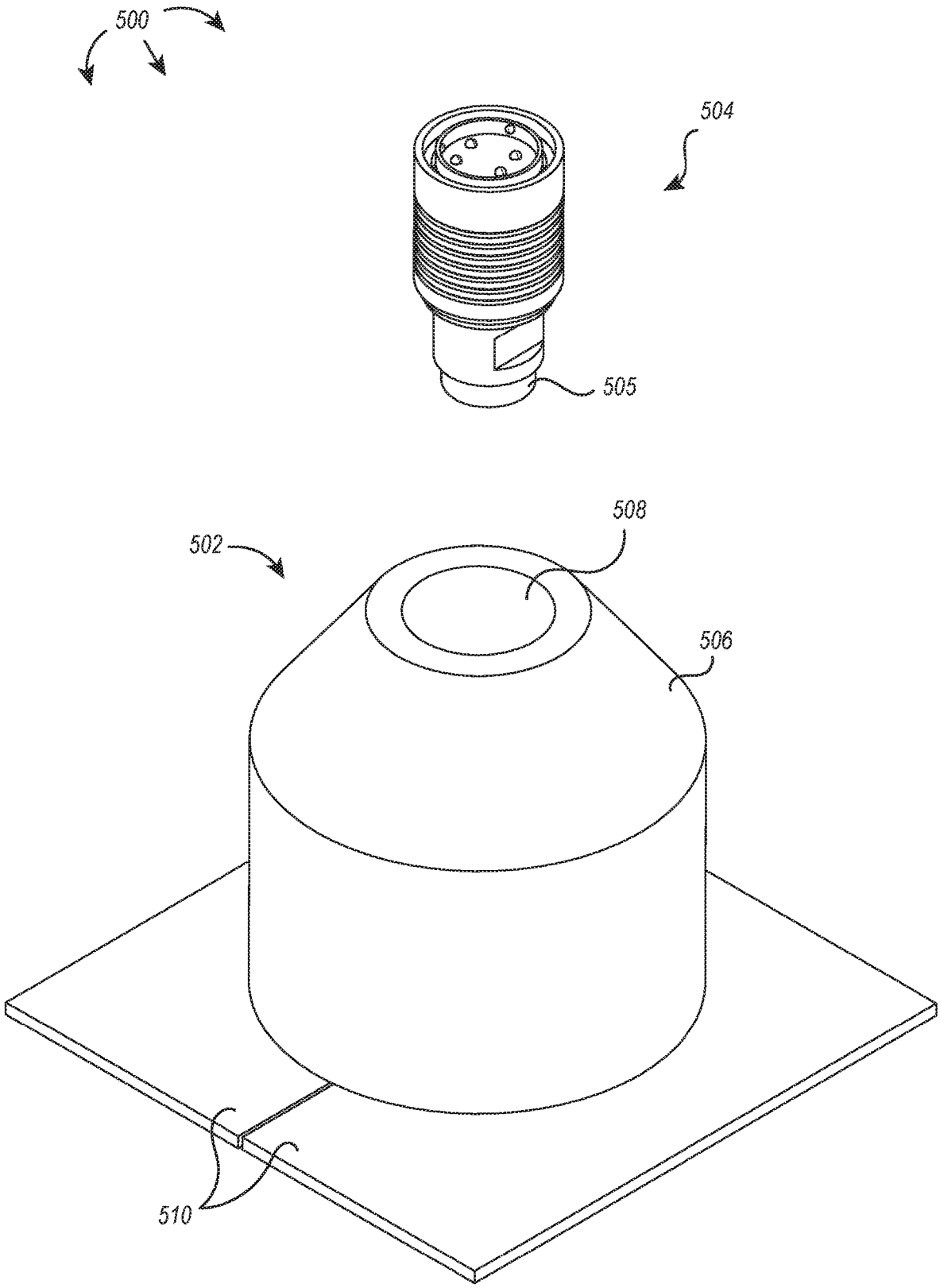
FIG. 19 illustrates a perspective view of another exemplary locking system.

Locking Systems Incorporating Engagement Surfaces Within the Tamper-Resistant Lock Another alternative embodiment of a locking system is illustrated in FIGS. 19 to 23. As illustrated in FIG. 19, the locking system 500 includes a tamper-resistant lock 502 and a key 504. The tamper-resistant lock 502 is engaging a hidden component (see, e.g., FIG. 23) through the outer lid or housing 506, thereby securing the housing 506 to the hidden component. The hidden component is configured in size and shape to be covered by the housing and thereby completely concealed from view by the housing 506. Accordingly, the hidden component is inaccessible without removing the housing. In the embodiment shown, the hidden component and the housing 506 are secured to a pair of hasps 510 that are commonly used to enable locking of a door or container with a padlock. As such, the locking system 500 can be used, for example, in place of a padlock as an improved tamper-resistant locking system.

As shown in FIG. 19, the exemplary locking system 500 includes at least one bore cap 508 that is arcuate with a smooth top surface. In some embodiments, and as illustrated in FIG. 19, the smooth top surface of bore cap 508 can be substantially circular. Due to the shape and smooth surface of the bore cap 508, some implementations exhibit a conspicuous lack of engagement surfaces for traditional tools. In other words, the bore cap 508 is not shaped to accommodate traditional crescent wrenches or similar tools, and there are no grooves or patterns on the surface of the bore cap 508 that would allow a screwdriver or hex key to grip, engage, or otherwise remove the cap. As such, the shaping and/or contour of the bore cap 508 can, in some embodiments, provide a first level of tamper resistance to the locking system 500. To a casual observer or potential thief, there is no readily obvious way of removing the lock as it appears to be riveted closed, fastened, or otherwise installed with a specialized tool.

In at least one embodiment, the bore cap 508 (or at least a portion thereof) is made of a ferrous material (e.g., iron, an iron alloy, or other materials exhibiting magnetic properties), and as shown in FIG. 2, the bore cap 508 can be engaged by and removed using a magnet 505. In the illustrated embodiment, the key 504 includes a magnet 505 with sufficient magnetic charge to remove the bore cap 508 from the housing 506. To remove the bore cap 508 from the bore 507 of the housing 506, the magnet 505 magnetically engages the upper surface of the bore cap 508, and the magnetic force between the bore cap 508 and the magnet 505 is greater than the resistive, frictional force provided by a rubber gasket 509 disposed between the sidewall of the bore cap 508 and the inner diameter of the bore 507. Accordingly, the magnet 505 gains and retains hold of the bore cap 508, allowing it to draw the bore cap 508 away from the bore 507 to disassociate the bore cap 508 from the housing 506 and thus reveal the cylindrical lock body 512.

In some embodiments, the bore cap includes a magnetic undersurface (or is itself magnetic), and the bore cap is magnetically held to a top surface of an associated ferrous cylindrical lock body. The magnet of the key would, consequently, need to be a more powerful magnet such that it can overcome the magnetic force holding the bore cap to the cylindrical lock body.

In some embodiments, the bore cap includes or is made of a resilient material (e.g., non-ferrous metals or metal alloys, carbon fiber or glass reinforced composite materials, etc.), and the key includes a suction cup or vacuum that can be used to draw the bore cap from the bore of the cylindrical lock body.

In some embodiments, the bore cap 508, cylindrical lock body 512, key 504, or any other component of the tamper-resistant lock 502 can be made from a hardened or strengthened material that resists drilling, concussive forces (e.g., hammer blows), slashing, tearing, or other destructive forces such as burning and low energy explosives. For example, the foregoing components can be made of hardened stainless steel. Thus, even at the superficial level of the bore cap 508, the tamper-resistant locks disclosed herein can be implemented to resist destructive tampering and prying, and there is beneficially (from the perspective of the lock owner) no obvious means of engaging the bore cap, which provides a first layer of defense against potential intrusive forces.

Figure 20:
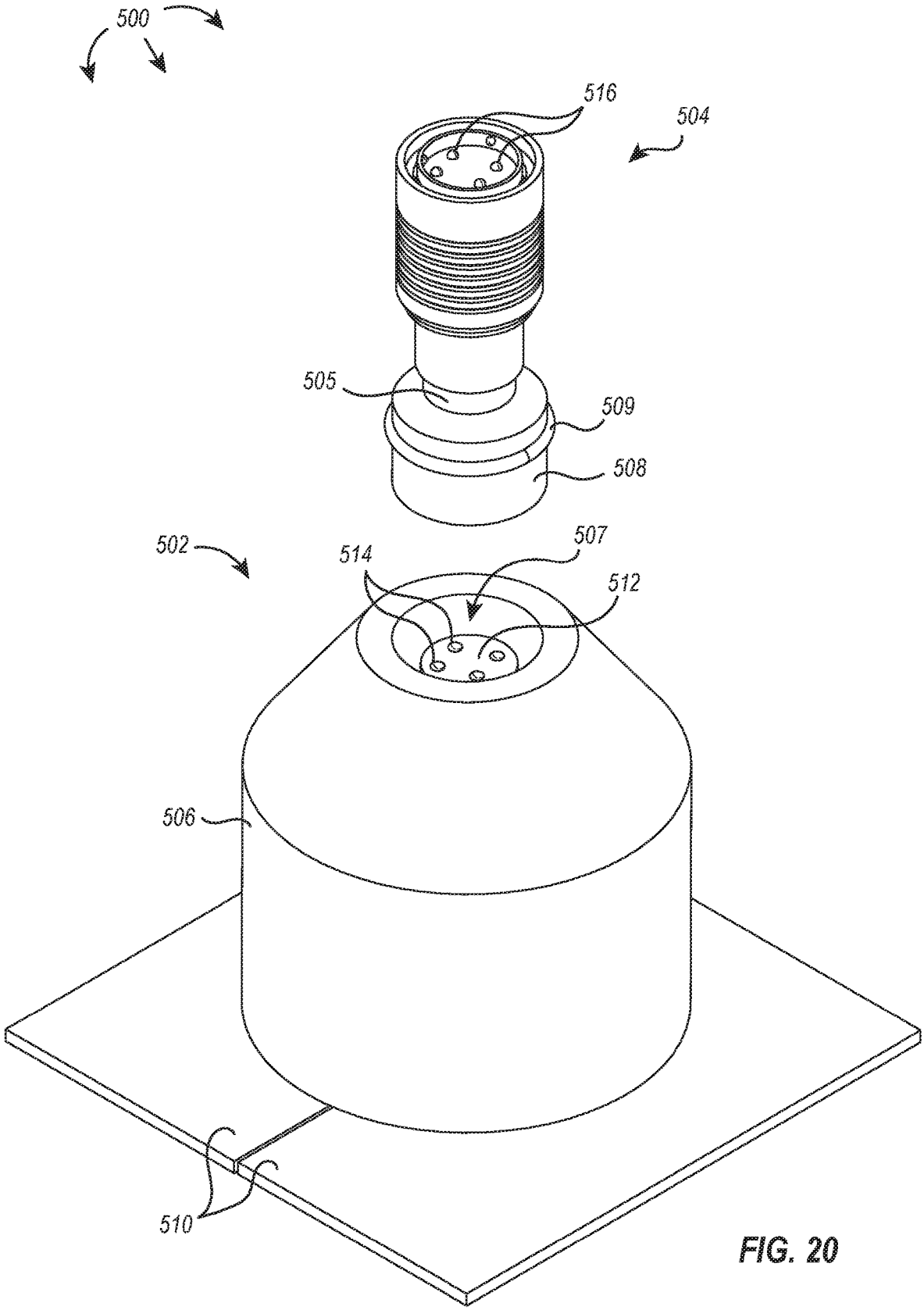
FIG. 20 illustrates a perspective view of the exemplary locking system of FIG. 19 with the cap removed, revealing the lock chamber.

With continued reference to FIG. 20, once the bore cap 508 is removed, the top of the cylindrical lock body 512 and the bore 507 become apparent. Similar to an installed bore cap 508, however, the top of the cylindrical lock body 512 exhibits a conspicuous lack of means for engagement by traditional tools. Rather, the now visible portion of the cylindrical lock body 512 may consist of a flat (e.g., bottom) surface with a pattern of engagement features 514 that, at least to the uninformed observer, comprise a pattern of small indents or recesses that would be an insufficient source of grip for any traditional tool, such as a screwdriver or a hex wrench. In some embodiments, for example, the engagement features 514 consist of hemi-spherical recesses, thus lacking the sharp edges needed to provide the necessary gripping means for a screwdriver head to torque the underlying component.

In some embodiments, if the bore cap is removed and the bore is viewed from an aerial position down the longitudinal axis of the bore, the cylindrical lock body appears as a cylindrical pedestal positioned within the bore. In particular, a portion of the cylindrical lock body extends above the bottom surface of the bore, and the cylindrical lock body does not engage the sidewalls of the bore. Rather, a space is defined between the sidewalls of the cylindrical lock body and the sidewalls of the bore (the sidewalls of the cylindrical lock body and the bore being substantially parallel to one another). The engagement features described above (e.g., indents or semi-circular recesses) are formed into the top surface of the portion of the cylindrical lock body that extends above the bottom surface of the bore. As such, when viewing the bore from an aerial position along the longitudinal axis of the bore, there remains no obvious manner in which the cylindrical lock body can be engaged using standard tools like a wrench or screwdriver, and the depth of the cylindrical lock body within the bore coupled with the small space between the cylindrical lock body and sidewall of the bore (e.g., less than 1 inch, preferably less than 0.5 inches) makes the use of pliers or levers for prying or otherwise gripping the lock body futile.

As shown in FIG. 20, the exemplary key 504 includes a set of complementary engagement features 516 that correspond with the engagement features 514 of the cylindrical lock body 512. In at least one embodiment and as described below in relation to FIGS. 27A and 27B, the set of complementary engagement features 516 of the key 504 protrude from a flat (e.g., bottom) surface of the cylindrical key body 524 and correspond to matching depressions in a corresponding surface of the cylindrical lock body 512.

Figure 21:
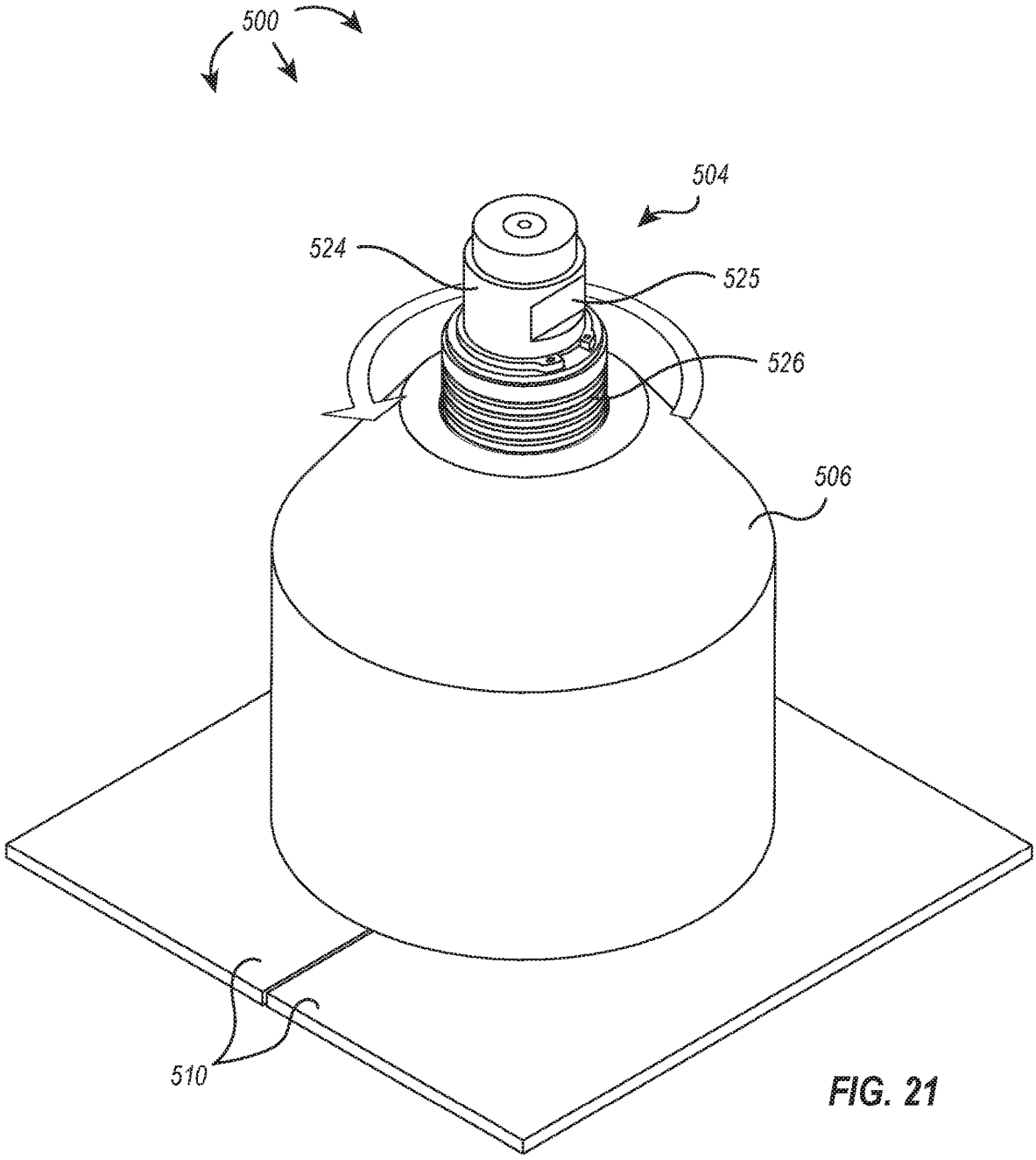
FIG. 21 illustrates a perspective view of the exemplary locking system of FIG. 20 with the key engaging the lock.
Figure 22:
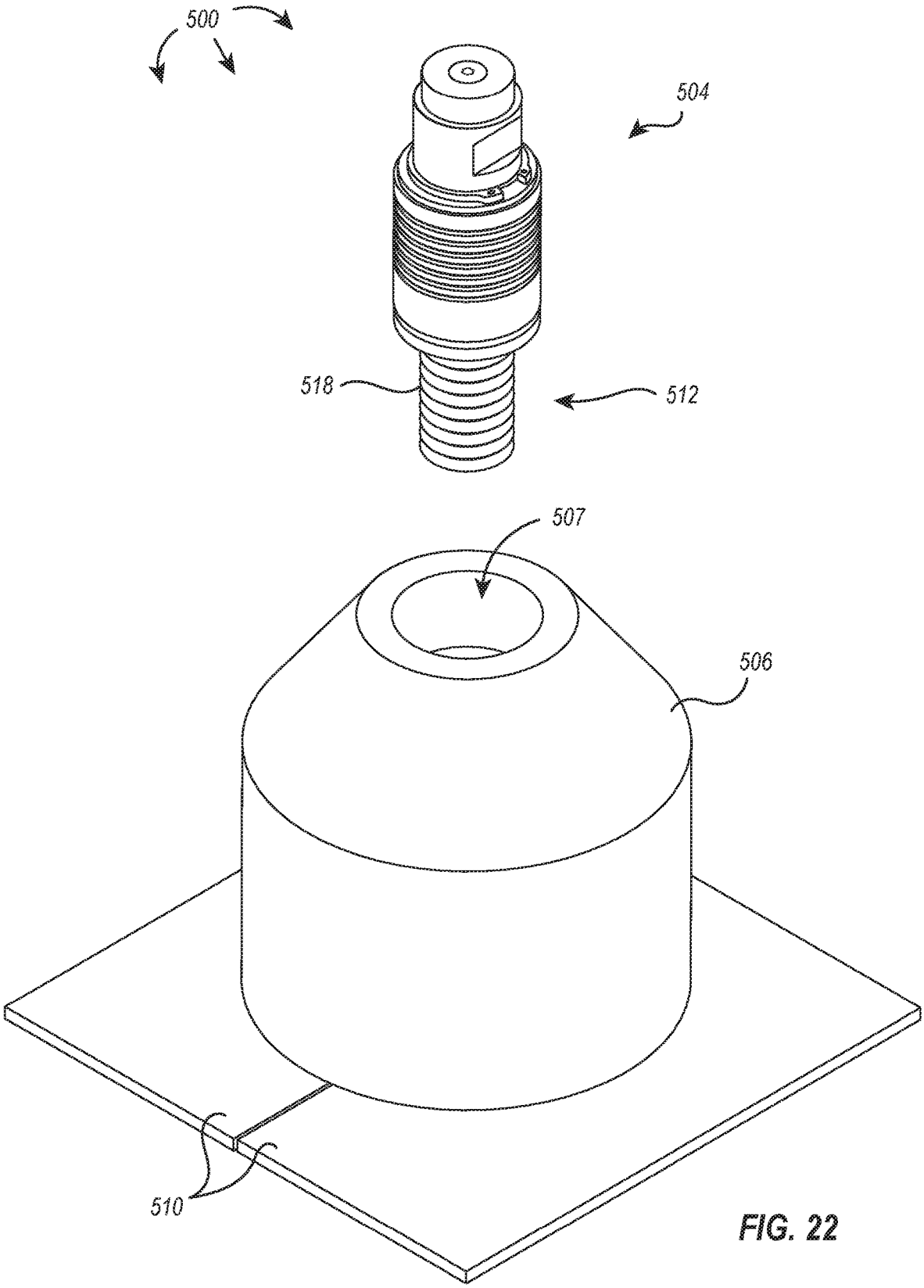
FIG. 22 illustrates a perspective view of the exemplary locking system of FIG. 21 with the lock removed from the housing.

As shown in FIGS. 21 and 22, the key 504 can be used to disengage the cylindrical lock body 512 from the housing 506 or other component with which the cylindrical lock body 512 has been integrated. The key 504 includes a cylindrical key body 524 and a collar 526 that are sized and shaped to fit within the bore 507, and when the key 504 is positioned within the bore 507, the set of complementary engagement features 516 of the key 504 engage with the engagement features 514 of the cylindrical lock body 512. A subsequent rotational force applied to the key 504 disengages the cylindrical lock body 512 from the housing 506 and/or underlying components with which the cylindrical lock body 512 is integrated. In at least one embodiment, and as shown in FIG. 21, an angular gripping surface 525 configured to receive a traditional wrench or similar tool can be provided on opposing sides of the key 504 to assist the user in rotating the cylindrical lock body 512.

As shown in FIG. 22, the cylindrical lock body 512 includes at least a length thereof having external threads 518. Accordingly, rotational forces applied to the cylindrical lock body 512 cause it to fasten or unfasten from the housing 506, depending on the direction of rotation. As illustrated, once the cylindrical lock body 512 is removed from the housing 506 and the underlying components, the housing 506 may be removed to reveal the previously hidden componentry of the locking system 500. In alternative embodiments, the cylindrical lock body may be used to secure any component having internal threads that correspond to the external threads 518 of the cylindrical lock body 512. See FIGS. 26A and 26B and the accompanying description below for further discussion of alternative applications of tamper-resistant lock 502.

Figure 23:
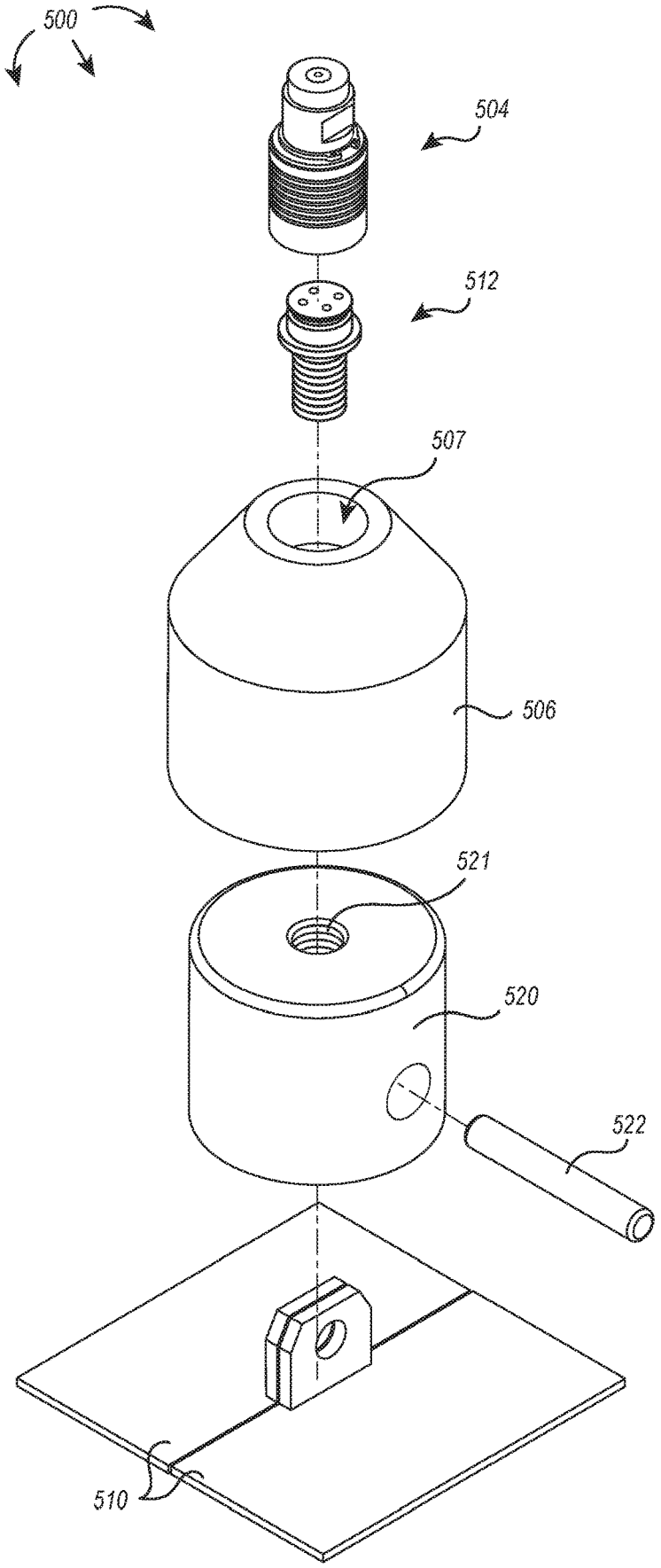
FIG. 23 illustrates an exploded perspective view of the exemplary locking system of FIGS. 19 through 22 with the illustrated lock being disengaged and the housing, padlock body and pin being removed, revealing the hasps of a door.
Figure 24A:
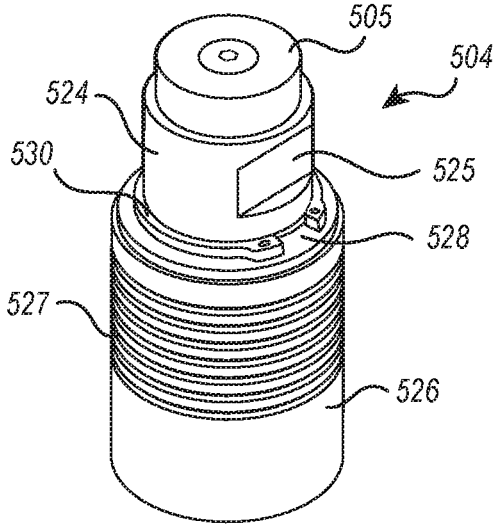
FIG. 24A illustrates a perspective view of an exemplary key for use with tamper-resistant locks disclosed herein.
Figure 24B:
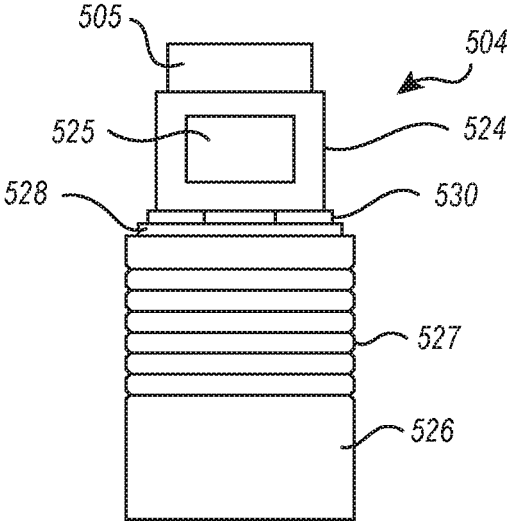
FIG. 24B illustrates a side view of the exemplary key of FIG. 24A.

Referring now to FIG. 23, the components of the exemplary locking system 500 from FIGS. 19-22 are shown in an exploded, disassembled state. Prior to removal of the cylindrical lock body 512, the threaded portion thereof is secured to an internal lock base 520 and a flange of the cylindrical lock body 512 engages the bottom surface of the bore 507 of the housing 506, preventing the housing from being removed. That is, in some embodiments, such as that shown in FIG. 23, the housing 506 comprises an outer shell that is preferably arcuate and smooth and/or devoid of gripping features on the exterior surface to thereby prevent or make more difficult the housing from being grasped (e.g., with a tool or manually) and rotated or otherwise leveraged away from the object to which it is anchored.

The bore 507 of housing 506 can pass at least partially into the body of the housing 506 and terminate at a bottom surface of the bore 507. In some instances, the sidewall defining the bore is featureless (e.g., smooth and unremarkable for a lack of structures formed therein or protruding therefrom). The bottom surface of the bore can define an aperture such that the bottom surface is a flange or flange-like in structure having a central aperture. The aperture can be sized and shaped as to allow the passage of the lower portion of the cylindrical lock body (e.g., the threaded stem) through the aperture where it can engage the internal lock body but prevent the passage of the upper portion and/or flange of the cylindrical lock body. Accordingly, as shown in FIG. 23, upon disengaging the cylindrical lock body 512 from the internal lock base 520 using the key 504, the housing 506 is free to be slid off—and now revealing to the user—the internal lock base 520.

The internal lock base 520 defines a complementary threaded bore 521 into which the cylindrical lock body 512 can fasten (e.g., via the threaded stem of the lower portion of the cylindrical lock body). As shown, the aperture of the complementary threaded bore 521 is defined by the top surface of the internal lock base 520, and the complementary threaded bore 521 extends downwardly away from the top surface and towards the center of internal lock base 520. On an opposing side thereof, the internal lock base 520 defines a receiving area sized and shaped to fit a pair of hasps 510. The internal lock base 520 can thereby be positioned over the hasps 510 such that the bottom of the internal lock base 520 abuts and rests against the doors or surface comprising the hasps 510. Once so positioned, a padlock pin 522 can be included and configured to pass through the pair of hasps 510 (e.g., by traversing a cavity formed in the base 520 in a direction orthogonal to a plane containing the hasps 510) to secure the hasps 510 to the internal lock base 520. The pair of hasps 510 can be associated with a door or other structure, such as a locker, drop box, toolbox, safe, gate, or munitions container. In some embodiments, the disclosed tamper-resistant lock can be associated with any other structure that could traditionally be secured with a padlock.

Accordingly, with continued reference to FIG. 23, the illustrated tamper-resistant lock can be used to lock or secure an object containing hasps 510 by first passing the internal lock base 520 over the pair of hasps 510. The padlock pin 522 can then be slid through the cavity formed in the sidewall of the internal lock base 520 to pass through the eyes of the pair of hasps 510, thereby securing the internal lock base 520 to the pair of hasps 510. The housing 506 can then be placed over the internal lock body, hiding it from view and structurally preventing the padlock pin 522 from disengaging the pair of hasps 510. The cylindrical lock body 512 can then be placed into the bore 507 of the housing 506 with the threaded stem passing through the aperture formed in the bottom surface of the bore 507 and threadedly engaging the complementary threaded bore 521. In some embodiments, the cylindrical lock body 512 can be drawn into association with the internal lock base 520 such that the flange or washer of the cylindrical lock body 512 abuts against the bottom surface of the bore 507, which can act to firmly secure the housing 506 to the internal lock base 520 (and in some instances to the surface of the doors or other structure containing the pair of hasps).

In some embodiments, the pair of hasps comprises a single hasp. Additionally, or alternatively, the tamper-resistant locks disclosed herein can be used to secure a hasp about a staple. For example, a securing mechanism (e.g., for a door or gate) can include a stationary post and a swinging door. The swinging door (or the stationary post) can be fitted with a staple configured in size and shape to pass through the aperture of a swinging hasp. Accordingly, the door can be shut and the hasp passed over the staple. The padlock pin can be passed through the eye of the staple to secure the hidden component of the lock, and the remainder of the tamper resistant lock can be assembled about the hidden component, as described above. In like manner, the tamper-resistant locks disclosed herein may be implemented and adapted to various embodiments to secure an object.

It should be appreciated that in some embodiments, the padlock pin is omitted. Instead, the cylindrical lock body passes through the hasps to secure the internal lock base and/or housing thereto. For example, the complementary threaded bore of the internal lock base could have a surface discontinuity or indent into which the hasps can pass, and by aligning the attendant apertures of the hasps with the complementary threaded bore, the cylindrical lock body can pass through the apertures of the hasps and thereby secure the hasps to the internal lock base. In such an embodiment, the internal lock base and/or housing may have a planar exterior sidewall that enables the lock base and/or housing to be placed flush against the doors comprising the hasps. Additionally, or alternatively, the internal lock base and the housing can be the same component as the lock base may no longer include an additional aperture for the padlock pin to pass through and engage the hasps (e.g., as shown in the embodiment of FIG. 23).

Accordingly, in some embodiments, the lock base and the housing may be the same component and can be configured in size and shape to receive a bore cap to occlude the presence of the bore and/or cylindrical lock body disposed therein. In some instances, the bore cap is flush with a planar surface of lock base/housing to prevent a user from leveraging the bore cap out of association with the bore. As above, the bore cap may be removed using a magnet of sufficient magnetic strength to overcome the friction between the bore cap seal and the sidewalls of the bore.

Exemplary Tamper-Resistant Locks and Associated Keys Incorporating Complimentary Engagement Surfaces FIGS. 24A through 25B illustrate an exemplary key 504 of the present disclosure. Unlike traditional keys having a slim profile, the illustrated key 504 includes a collar 526 and a cylindrical key body 524 being at least partially covered by the retractable collar 526. In some embodiments, a magnet 505 may be attached to a first side of the cylindrical key body 524 to provide means for removing a bore cap or other ferrous component as discussed above in relation to FIGS. 19 and 20. The cylindrical key body 524 can also include angular gripping surfaces 525 on opposing sides of the cylindrical key body 524 configured to receive a wrench or similar tool for assisting in rotating the key 504 in order to disengage the tamper-resistant lock. Alternatively, the angular gripping surface can be replaced by knurling, a rubberized material, or other forms of texturing to assist in the rotating of the key by a user without the need of a wrench or similar tool. In some embodiments, the angular gripping surface of the cylindrical key body or the cylindrical key body itself is adapted for use with a power tool (e.g., as a bit or terminal adaptor for a tool powered by an electric-, combustion-, or compressed air-driven motor).

A gripping surface 527 can also be included on an outer diameter of the retractable collar 526 to assist the user in retracting the retractable collar 526 as described below. It should be appreciated that the gripping surface 527 can be comprised of a textured surface, a rubberized material, or any similar means for providing additional grip on the surface of the retractable collar 526.

Figure 25A:
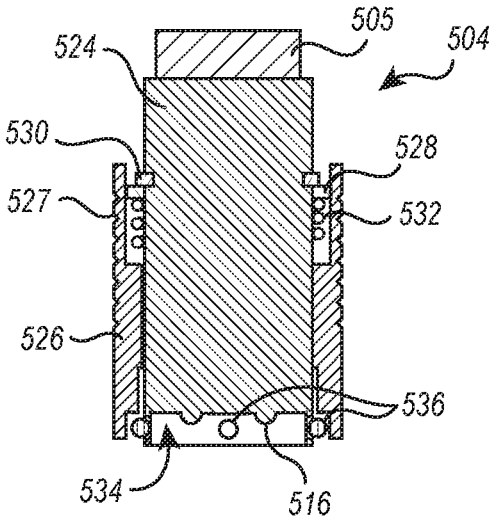
FIG. 25A illustrates a cross-sectional view of the exemplary key of FIGS. 24A and 24B, wherein the internal spring is in a compressed state.
Figure 25B:
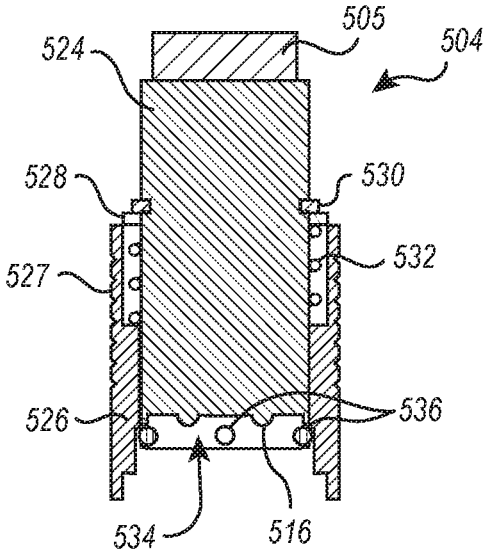
FIG. 25B illustrates a cross-sectional view of the exemplary key of FIG. 25A, wherein the internal spring is in a decompressed state.

As illustrated in the cross-sections of FIGS. 25A and 25B, the cylindrical key body 524 can be at least partially disposed within the retractable collar 526, the retractable collar 526 being secured to the cylindrical key body 524 by a washer 528 and a retention spring 530. A spring 532 can also be disposed between the retractable collar 526 and the cylindrical key body 524, such that the retractable collar 526 is retractable and axially spring-loaded. For example, as shown in FIGS. 25A and 25B, the spring 532 can be disposed around the cylindrical key body 524 and within a compartment formed by a thinned sidewall portion of the retractable collar 526, the cylindrical key body 524, and the retention spring 530. Upon axial movement of the retractable collar 526, the retractable collar presses against the spring 532 until the washer 528 and/or spring 532 abut against the fixed retention spring 530. Continued axial movement of the retractable collar 526 causes the spring to compress within the compartment and provide tension to the axial movement of the retractable collar.

A lower end of the cylindrical key body 524 can also define an engagement cavity 534 configured to receive an engagement surface of a corresponding cylindrical lock body. The lower end of the cylindrical key body 524 can also define a plurality of openings into which retractable engagement members can be positioned, the purpose of such to be explained in detail below in relation to FIGS. 27A and 27B. In the illustrated embodiment, the retractable engagement members comprise steel bearing balls 536. It should be appreciated, however, that other forms of retractable engagement members may be utilized, depending upon the size and intended application of the tamper-resistant lock 502.

In some embodiments and as shown in FIG. 25A, when the retractable collar 526 is retracted (e.g., in a retracted position), the spring 532 is compressed, and the bearing balls 536 can at least partially withdraw from the engagement cavity 534 by being depressed within the retractable collar 526. As described in detail below in relation to FIG. 27A, withdrawal of the bearing balls 536 allows for the corresponding lock body to be inserted into the engagement cavity 534 without interference. As shown in FIG. 25B, the bearing balls 536 protrude into the engagement cavity 534 when the retractable collar 526 is released and the spring 532 decompressed (e.g., when the retractable collar is in a non-retracted position).

Figure 26A:
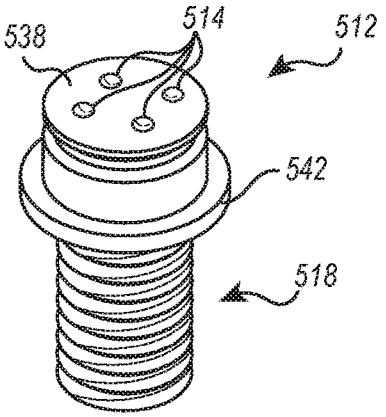
FIG. 26A illustrates a perspective view of an exemplary cylindrical lock body of a tamper-resistant lock.
Figure 26B:
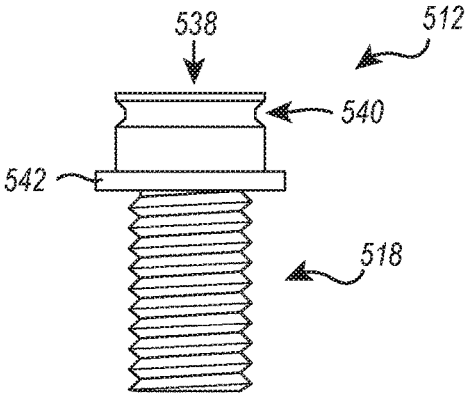
FIG. 26B illustrates a side view of the exemplary cylindrical lock body of FIG. 26A.

Referring to FIGS. 26A and 26B, an exemplary cylindrical lock body 512 is shown. As illustrated, the cylindrical lock body 512 can include a portion (e.g., a lower portion, as shown in FIGS. 26A and 26B) with external threads 518. The lower portion can be, for example, the threaded stem of a bolt. The cylindrical lock body 512 can additionally include a washer or flange 542 disposed between the lower portion and an upper portion having an engagement surface 538 configured to mate with a corresponding surface of an associated key. The upper portion can additionally include a circumferential channel 540 configured to integrate with and/or receive one or more retractable engagement members, such as a steel ball bearing. In some embodiments, the circumferential channel is interrupted at one or more points around the circumference of the upper portion and/or includes discrete pockets formed into the circumferential sidewall of the upper portion that are sized and shaped to receive retractable engagement members.

The engagement surface 538 of the illustrated cylindrical lock body 512 are arranged in a pattern of engagement features 514 such as, for example, a series of semi-spherical indents configured to integrate with a series of complementary semi-spherical protrusions patterned on the key corresponding to cylindrical lock body 512. It should be appreciated that the engagement features associated with the lock body could alternatively be protrusions with complementary indents on an associated key and/or the engagement features of the lock body could be a mix of protrusions and indents that matching a complementary set of protrusions and indents on an associated key. In at least one embodiment, the cylindrical lock body 512 includes a washer or flange 542 to provide for a greater distribution of pressure when the cylindrical lock body 512 is secured to another component by the threads 518.

It should further be appreciated that the illustrated cylindrical lock body 512 can be used in a wide range of applications to secure goods and materials against unauthorized access or theft. The implementation described above, for example, utilizes a tamper-resistant housing and bore cap to secure two door hasps that would generally be secured by a traditional padlock. Alternatively, the hasps can be secured without the use of a tamper-resistant housing.

In some embodiments, the threaded portion of the cylindrical lock body can be reversed such that the threads are provided on an interior surface of the cylindrical lock body. In this configuration, the lock cylindrical lock body can be configured to replace the lug nuts that are traditionally used to secure the wheel of a vehicle. Traditional lug nuts, including those that require a key or adaptor, are relatively easy for an unauthorized person or thief to access because the keys and/or tire wrenches are widely available. Embodiments of the present disclosure include cylindrical lock bodies that require a matching key with a unique configuration of surfaces that cannot be duplicated without high-precision machinery and a detailed understanding of the locking mechanism.

For example, a tamper-resistant lock of the present disclosure can be configured for use as a lug nut to secure the wheel of a vehicle. Such a lock can include, for example, a housing, a lock body, and a bore cap. The housing can be configured with a central bore through which the threaded stem of a lug bolt or stud (i.e., to which the lug nut is traditionally attached) is received. The lock body includes a set of interior threads configured to engage the threaded lug bolt. In some embodiments, the housing additionally includes a flange extending from the interior sidewall of the bore. Upon threadedly engaging the lock body with the lug bolt of the wheel, the lock body can come into contact with the flange of the housing and cause the housing to be pressed into tighter association with the wheel base or rim as the lock body is further rotated/engaged about the complementary lug bolt.

In some embodiments, the lock body is similar in appearance and contains similar features to the upper portion of the cylindrical lock body depicted in FIGS. 26A and 26B. For example, a lock body for use as a lug nut can include a washer or flange (e.g., to engage the flange of the housing) and an upper end having an engagement surface configured to mate with a corresponding surface of an associated key and a circumferential channel configured to integrate with and/or receive one or more retractable engagement members, such as a steel ball bearing. However, instead of the externally threaded stem illustrated in FIGS. 26A and 26B, the lock body can include internal threads for receiving a complementary lug bolt. As above, the engagement features on the engagement surface of the lug-nut-adapted lock body can be formed in a unique pattern to match a particular key, thereby adding to the theft- and tamper-resistant nature of the lug nut.

Once the lug-nut-adapted lock body is sufficiently tightened to the associated lug bolt (e.g., using a torque wrench set to the manufacturer's suggested torque for the given wheel), a bore cap can be placed over the bore opening to occlude the lock body from view. The bore cap may be flush with the surface of the housing to prevent/remove edges that can be leveraged with a common hand tool (e.g., a screwdriver or other lever). Instead, the bore cap can be made of or include ferrous material, allowing its removal from the housing with the use of a sufficiently powerful magnet.

It should be appreciated that in some embodiments, the aforementioned tamper-resistant, lug-nut-adapted lock can be configured to retrofit and/or replace traditional lug nuts on presently manufactured wheels.

Other embodiments and uses of the disclosed cylindrical lock body include any application wherein a user desires to secure a component using a threaded bolt or nut (i.e., the cylindrical lock body) that cannot be removed without the proper complementary key.

Figure 27A:
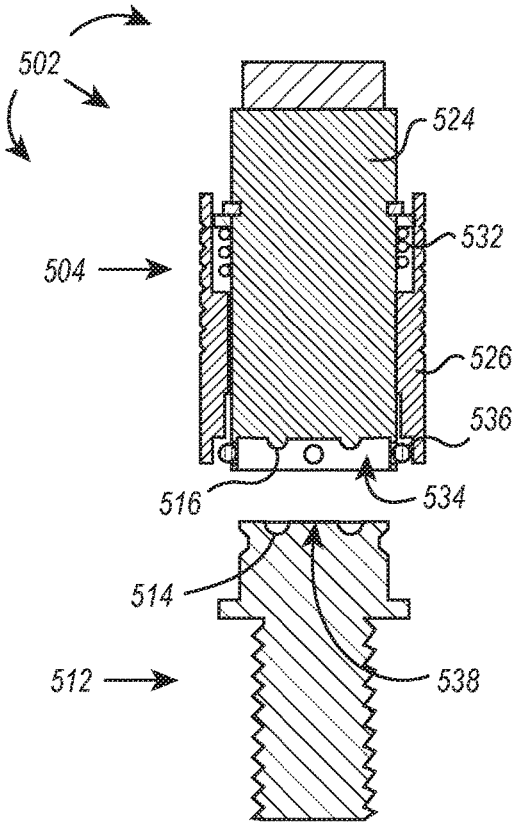
FIG. 27A illustrates a cross-sectional view of an exemplary tamper-resistant lock with the exemplary key of FIGS. 24A through 25B in proximity to the exemplary cylindrical lock body of FIGS. 26A and 26B.
Figure 27B:
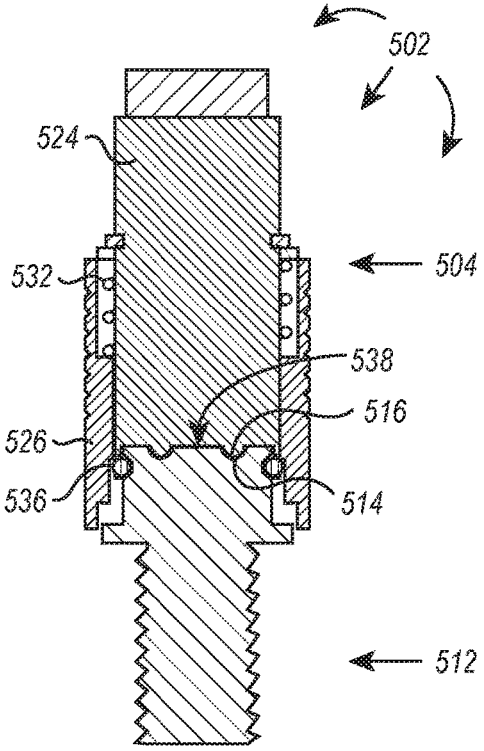
FIG. 27B illustrates a cross-sectional view of the exemplary tamper-resistant lock of FIG. 27A with the exemplary key engaging the exemplary cylindrical lock body.

FIGS. 27A and 27B illustrate cross-sectional views of an exemplary tamper-resistant lock 502 comprised of a cylindrical lock body 512 and associated key 504. FIG. 27A shows the key 504 with the retractable collar 526 retracted and the spring 532 in a compressed state (e.g., in a retracted position), the key 504 thus being prepared to integrate with the cylindrical lock body 512. With the retractable collar 526 retracted, the bearing balls 536 can withdraw from the engagement cavity 534, thus allowing for insertion of the engagement surface 538 of the cylindrical lock body 512 into the matching engagement cavity 534. Once the cylindrical lock body 512 has been inserted into the engagement cavity 534, the retractable collar 526 may be released to achieve the non-retracted configuration shown in FIG. 27B.

As shown in FIG. 27B, mating of the engagement surface 538 of the cylindrical lock body 512 with the engagement cavity 534 of the key 504 enables the bearing balls 536 to integrate with the circumferential channel 540, such that the spring 532 may decompress and the retractable collar 526 can slide over the bearing balls 536 to hold them in position within the circumferential channel 540. In at least the embodiment shown, alignment of the set of complementary engagement features 516 of the key with the engagement features 514 of the lock is required for the key 504 to be capable of applying a rotational force to the cylindrical lock body 512 and thereby disengage the tamper-resistant lock 502. Stated another way, the lock 502 can only be disengaged if the configurations of the engagement features 514, 516 sufficiently match to allow for the engagement surface 538 to fit flush within the engagement cavity 534 such that the bearing balls 536 may sufficiently integrate with the circumferential channel 540 to form a solid attachment between the key 504 with the cylindrical lock body 512. If an attempt is made to engage the cylindrical lock body 512 with a key having improper configuration of engagement features, for example, the key will not be able to engage the cylindrical lock body 512 (e.g., because the bearing balls are not received within the circumferential channel due to the mismatched engagement features) and thus will not be able to apply the rotational force necessary to disengage the lock 502. In order to prevent duplication or falsification of the proper key 504, some embodiments utilize engagement features 514, 516 that require a high-precision machine to create a configuration at a machining tolerance that would be unachievable or very difficult without the proper machine and/or equipment.

In some embodiments, engaging the bearing balls within the circumferential channel further secures the matching engagement features. That is, the act of the bearing balls entering the channel may draw the key into tighter association with the lock body. In some embodiments, the channel is sufficiently deep to receive at least half of the bearing ball. Alternatively, the circumferential channel is interrupted such that the bearing balls enter corresponding pockets formed into the circumferential sidewall of the upper portion of the cylindrical lock body.

Figure 28:
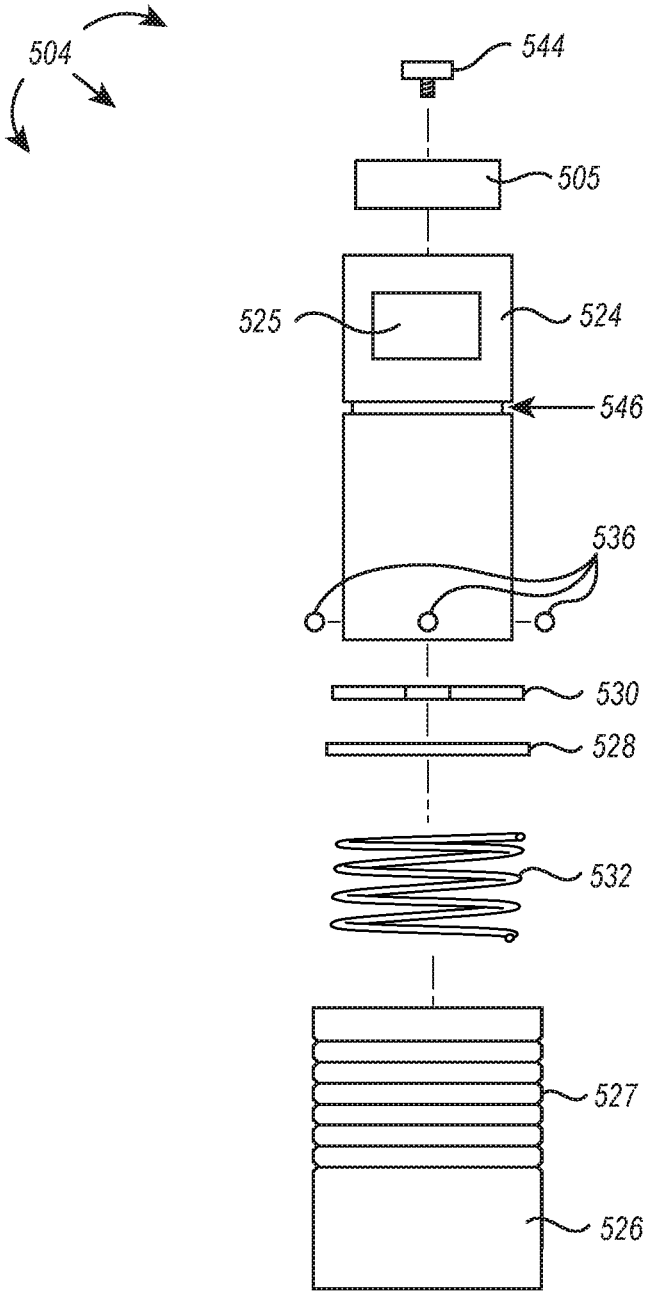
FIG. 28 illustrates an exploded view of the exemplary key of FIGS. 24A through 25B.

FIG. 28 illustrates an exploded view of the exemplary key 504. As illustrated, the key 504 comprises multiple components that can be assembled to form a unitary apparatus for engaging the cylindrical lock body 512 (see, e.g. FIG. 27B). In some embodiments, the key 504 includes a cylindrical key body 524 having an angular gripping surface 525 configured to receive a traditional wrench or similar tool, and a circumferential groove 546 configured to receive a retention spring 530 to secure the remaining components of the key 504 in place. In some embodiments, a magnet 505 is attached to a first side of the cylindrical key body 524 by a retention bolt 544. The key 504 can also include a collar 526 having a gripping surface 527 configured to assist the user in operating the key 504. Also, a spring 532 can be included beneath the retractable collar 526 to provide tension to the axial movement of the retractable collar 526. The retractable collar 526 and spring 532 can be held in position by a washer 528 and a retention spring 530, and one or more bearing balls 536 can be installed between the retractable collar 526 and the cylindrical key body 524 (see FIGS. 25A and 25B).

Conclusion

Unless defined otherwise, all technical and scientific terms used herein have the same meaning as commonly understood by one of ordinary skill in the art to which the present disclosure pertains.

Any headings used herein are for organizational purposes only and are not meant to be used to limit the scope of the description or the claims.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

We claim:

1. A locking system, comprising:

a tamper-resistant lock, comprising:

a cylindrical lock body that includes a lower portion and an upper portion, the lower portion having a threaded stem, and the upper portion having a pocket formed into a circumferential sidewall of the upper portion and an engagement surface defining a pattern of engagement features;

a housing having a bore formed into a top surface thereof; and a hidden component sized and shaped to fit within the housing, the hidden component comprising:

an internal lock base that defines a complementary threaded bore into which the threaded stem of the cylindrical lock body fastens; and a padlock pin configured in size and shape to fit within a cavity formed in a sidewall of the internal lock base and to pass through an eye of a hasp or staple to thereby secure the internal lock base to the hasp or staple; and a key operable for use with the tamper-resistant lock, comprising:

a cylindrical key body defining an engagement cavity configured to receive the engagement surface and the pocket of the upper portion of the cylindrical lock body;

a set of complementary engagement features defined by an interaction surface of the cylindrical key body;

a plurality of retractable engagement members disposed within corresponding openings defined by the cylindrical key body; and a retractable collar at least partially covering the cylindrical key body.

2. The locking system of claim 1, wherein the retractable collar is movable between a retracted state and a non-retracted state and the key is operable to disengage the cylindrical lock body from the tamper-resistant lock only in the non-retracted state with the pattern of engagement features of the tamper-resistant lock aligned with the set of complementary engagement features of the key.

3. The locking system of claim 2, wherein the pocket extends circumferentially around the circumferential sidewall of the upper portion to form a circumferential channel.

4. The locking system of claim 3, wherein the retractable collar biases the plurality of retractable engagement members into the circumferential channel in the non-retracted state with the pattern of engagement features of the tamper-resistant lock aligned with the set of complementary engagement features of the key.

5. The locking system of claim 2, wherein the key further comprises a retention spring fixedly secured to the cylindrical key body and positioned on a first side of a spring disposed around the cylindrical key body and underneath the retractable collar to provide tension to an axial movement of the retractable collar, and wherein in the retracted state, the spring is compressed and the plurality of retractable engagement members can at least partially withdraw from the engagement cavity by being depressed within the corresponding openings, thereby allowing the corresponding lock body to be inserted into the engagement cavity without interference from the plurality of retractable engagement members.

6. The locking system of claim 5, wherein in the non-retracted state, the spring is decompressed and the plurality of retractable engagement members protrude into the engagement cavity.

7. The locking system of claim 1, wherein the plurality of retractable engagement members comprise bearing balls.

8. The locking system of claim 1, wherein the key further comprises a magnet associated with the cylindrical key body.

9. The locking system of claim 1, wherein a sidewall defining the bore is featureless.

10. The locking system of claim 9, wherein the tamper-resistant lock further comprises a bore cap sized and shaped to fit within and occlude the opening of the bore.

11. The locking system of claim 10, wherein the bore cap comprises a hollow cylindrical body having a flat, continuously smooth top surface such that in a secured position within the bore, the top surface of the bore cap is flush with a planar surface of the housing.

12. The locking system of claim 11, wherein the bore cap additionally comprises a sealing member disposed on an exterior surface of the hollow cylindrical body that engages the sidewall defining the bore to retain the bore cap within the bore.

13. A locking system, comprising:

a pair of hasps, each hasp having an eye;

a tamper-resistant lock configured to secure the pair of hasps, the tamper-resistant lock comprising:

a cylindrical lock body that includes a lower portion and an upper portion, the lower portion having a threaded stem, and the upper portion having a circumferential channel formed into a circumferential sidewall of the upper portion and an engagement surface defining a pattern of engagement features;

a housing having a bore formed into a top surface thereof; and a hidden component sized and shaped to fit within the housing, the hidden component comprising:

an internal lock base that defines a complementary threaded bore into which the threaded stem of the cylindrical lock body fastens; and a padlock pin configured in size and shape to fit within a cavity formed in a sidewall of the internal lock base and to pass through each eye of the pair of hasps to thereby secure the internal lock base to the pair of hasps; and a key operable for use with the tamper-resistant lock, comprising:

a cylindrical key body defining an engagement cavity configured to receive the engagement surface and the circumferential channel of the upper portion of the cylindrical lock body;

a set of complementary engagement features defined by an interaction surface of the cylindrical key body;

a plurality of retractable engagement members disposed within corresponding openings defined by the cylindrical key body; and a retractable collar at least partially covering the cylindrical key body.

14. The locking system of claim 13, wherein the retractable collar is movable between a retracted state and a non-retracted state and the key is operable to disengage the cylindrical lock body from the tamper-resistant lock only in the non-retracted state with the pattern of engagement features of the tamper-resistant lock aligned with the set of complementary engagement features of the key and the retractable collar biasing the plurality of retractable engagement members into the circumferential channel.

15. The locking system of claim 13, wherein the tamper-resistant lock further comprises a bore cap comprising ferrous material and being sized and shaped to fit within and occlude the opening of the bore.

16. The locking system of claim 15, wherein the key additionally comprises a magnet configured to magnetically engage and remove the bore cap from the bore.

17. The locking system of claim 13, wherein fitting the hidden component within the housing prevents the padlock pin from disengaging the pair of hasps.

18. A locking system, comprising:

a tamper-resistant lock, comprising:

a cylindrical lock body that includes a flange disposed between a lower portion and an upper portion, the lower portion having a threaded stem, and the upper portion having a circumferential channel formed into a circumferential sidewall of the upper portion and an engagement surface defining a pattern of engagement features;

a housing having a bore formed into a top surface thereof;

a bore cap sized and shaped to fit within and occlude an opening of the bore, the bore cap comprising ferrous material and a head having a flat, continuously smooth top surface such that in a secured position within the bore, the top surface of the bore cap is configured to be flush with a planar surface of the housing; and a hidden component sized and shaped to fit within the housing, the hidden component comprising:

an internal lock base that defines a complementary threaded bore into which the threaded stem of the cylindrical lock body fastens; and a padlock pin configured in size and shape to fit within a cavity formed in a sidewall of the internal lock base and to pass through an eye of a hasp or staple to thereby secure the internal lock base to the hasp or staple; and a key operable for use with the tamper-resistant lock, comprising:

a cylindrical key body sized and shaped to be at least partially disposed within the bore of the housing, the cylindrical key body defining an engagement cavity configured to receive the engagement surface and the circumferential channel of the upper portion of the cylindrical lock body;

a magnet associated with the cylindrical key body;

a set of complementary engagement features defined by an interaction surface of the cylindrical key body, the interaction surface being disposed within the engagement cavity;

a plurality of retractable engagement members disposed within corresponding openings defined by the cylindrical key body; and a retractable collar at least partially covering the cylindrical key body.

19. The locking system of claim 18, wherein the key further comprises a retention spring fixedly secured to the cylindrical key body and positioned on a first side of a spring disposed around the cylindrical key body and underneath the retractable collar to provide tension to an axial movement of the retractable collar.

20. The locking system of claim 18, wherein the retractable collar is movable between a retracted state and a non-retracted state and the key is operable to disengage the cylindrical lock body from the tamper-resistant lock only in the non-retracted state with the pattern of engagement features of the tamper-resistant lock aligned with the set of complementary engagement features of the key and the retractable collar biasing the plurality of retractable engagement members into the circumferential channel.

* * * * *